US010480154B2

(12) United States Patent
Breuer et al.

(10) Patent No.: US 10,480,154 B2
(45) Date of Patent: Nov. 19, 2019

(54) IMPLEMENT CARRIER AND IMPLEMENTS

(71) Applicant: Clark Equipment Company, West Fargo, ND (US)

(72) Inventors: Jim M. Breuer, Mandan, ND (US); Kevin J. Zent, Bismarck, ND (US); Jonathan J. Roehrl, Bismarck, ND (US); Scott N. Schuh, Bismarck, ND (US)

(73) Assignee: Clark Equipment Company, West Fargo, ND (US)

( * ) Notice: Subject to any disclaimer, the term of this patent is extended or adjusted under 35 U.S.C. 154(b) by 353 days.

(21) Appl. No.: 13/774,863

(22) Filed: Feb. 22, 2013

(65) Prior Publication Data

US 2013/0216347 A1 Aug. 22, 2013

Related U.S. Application Data

(60) Provisional application No. 61/601,928, filed on Feb. 22, 2012, provisional application No. 61/706,988, filed on Sep. 28, 2012.

(51) Int. Cl.
*E02F 3/413* (2006.01)
*E02F 3/30* (2006.01)
(Continued)

(52) U.S. Cl.
CPC ..... *E02F 3/4135* (2013.01); *E02F 3/30* (2013.01); *E02F 3/325* (2013.01); *E02F 3/3604* (2013.01);
(Continued)

(58) Field of Classification Search
CPC ..... E02F 3/404; E02F 3/413
See application file for complete search history.

(56) References Cited

U.S. PATENT DOCUMENTS 3,281,119 A * 10/1966 Westfall ..... B60P 3/41 414/739
3,305,118 A * 2/1967 Lull ..... B66F 9/0655 414/740
(Continued)

FOREIGN PATENT DOCUMENTS

CN 101381996 A 3/2009
CN 101949157 A 1/2011
(Continued)

OTHER PUBLICATIONS

Search Report and Written Opinion dated May 23, 2013 for International Application No. PCT/US2013/027467 filed Feb. 22, 2013, 11 pages.
(Continued)

*Primary Examiner* — Gerald McClain
(74) *Attorney, Agent, or Firm* — John D. Veldhuis-Kroeze; Westman, Champlin & Koehler, P.A.

(57) ABSTRACT

Disclosed embodiments include implement carriers and power machines with implement carriers. In some embodiments, the implement carriers have a mounting structure having first and second mounting structure surfaces with first and second pluralities of mounting features located along the first mounting structure surfaces, respectively. Each of the second plurality of mounted features is aligned with one of the first plurality of mounting features. The mounting structure is configured to receive an implement in a first attitude and a second attitude different from the first attitude.

19 Claims, 22 Drawing Sheets

(51) Int. Cl.
*E02F 3/36* (2006.01)
*E02F 3/32* (2006.01)
*E02F 3/40* (2006.01)

(52) U.S. Cl.
CPC ..... *E02F 3/3686* (2013.01); *E02F 3/404* (2013.01); *Y10T 403/20* (2015.01)

(56) References Cited

U.S. PATENT DOCUMENTS 4,106,646 A * 8/1978 Weisgerber ..... B66F 9/18 414/732
4,230,435 A 10/1980 Azevedo
4,285,628 A * 8/1981 Jankowski ..... E02F 3/404 414/739
4,519,739 A * 5/1985 Risch ..... E02F 3/404 414/739
4,925,359 A * 5/1990 Dunnegan ..... E02F 3/4075 414/704
5,472,308 A 12/1995 Somero
5,544,435 A 8/1996 Somero
5,553,408 A 9/1996 Townsend
5,678,323 A * 10/1997 Domingue ..... F26B 17/205 34/209
5,678,332 A 10/1997 Hawkins
5,813,822 A 9/1998 Pisco
5,957,650 A 9/1999 Rollo
6,088,938 A 7/2000 Logan
6,088,939 A 7/2000 Logan
6,223,828 B1 * 5/2001 Paulson ..... E02F 3/962 171/110
6,269,560 B1 8/2001 Pratt
6,640,471 B2 11/2003 Desrochers
6,655,053 B1 12/2003 Cummungs
6,655,900 B1 * 12/2003 Knutson ..... E02F 3/404 414/729
6,659,709 B1 12/2003 Anderson
7,241,101 B2 * 7/2007 Bauer ..... E02F 3/404 414/726
7,533,481 B2 5/2009 McCoy
7,946,063 B2 * 5/2011 Paull ..... E02F 3/815 37/407
8,069,591 B2 * 12/2011 Dunn ..... E02F 3/404 414/724
8,615,907 B2 * 12/2013 Miller ..... E02F 3/404 414/729
8,834,090 B1 * 9/2014 Callens ..... E02F 3/404 414/724
2002/0101107 A1 8/2002 Cunningham et al.
2003/0167662 A1 * 9/2003 Desrochers ..... E02F 3/404 37/406
2003/0204973 A1 * 11/2003 Grgic ..... E02F 3/962 37/407
2006/0283055 A1 12/2006 Archuleta et al.
2007/0289173 A1 12/2007 Riffle
2008/0307681 A1 12/2008 McNeil
2013/0042507 A1 * 2/2013 Seda ..... E02F 3/404 37/406
2019/0127947 A1 * 5/2019 Zent ..... E02F 3/437

FOREIGN PATENT DOCUMENTS

IE 84063 11/2005
WO 2007064700 6/2007

OTHER PUBLICATIONS

Chinese Office Action and English Translation dated Oct. 9, 2015 for Chinese Application No. 201380010702.1, 13 pages.
Communication from the European Patent Office dated Oct. 10, 2016 for European Application No. 13707528.9, 5 pages.
Communication from European Patent Office dated Mar. 7, 2018 for European Application No. 13 707 528.9, 3 pages.
Canadian Office Action dated Nov. 22, 2018 for Canadian Application No. 2,864,586, 4 pages.

* cited by examiner

IMPLEMENT CARRIER AND IMPLEMENTS

CROSS REFERENCE TO RELATED APPLICATIONS

This application claims the benefit of U.S. Provisional Patent Application 61/601,928 filed on Feb. 22, 2012, and U.S. Provisional Patent Application 61/706,988 filed on Sep. 28, 2012, the contents of which are incorporated by reference into this application in their entirety.

BACKGROUND

Some power machines, including excavators, are configured to utilize a primary implement, often in the form of a backhoe bucket available for attachment to a lift arm. Some power machines also provide a secondary implement on the same lift arm as the primary implement, often in the form of a hydraulically powered clamp that is opposable to the primary implement. One example of such a secondary implement is a so-called thumb implement on a lift arm of an excavator. The typical thumb implement is limited in function to cooperating with the primary implement for pinching objects between the primary and secondary implements, and is typically used to pick-up and place objects such as rocks or construction debris.

The discussion above is merely provided for general background information and is not intended to be used as an aid in determining the scope of the claimed subject matter.

SUMMARY

In one embodiment, an implement carrier is disclosed. The implement carrier has a mounting structure with first and second mounting structure surfaces. A first plurality of mounting features are located along the first mounting structure surface and a second plurality of mounting features are located along the second mounting structure surface. Each of the second plurality of mounting features is aligned with one of the first plurality of mounting features. The mounting structure is configured to receive an implement in a first attitude and in a second attitude different from the first attitude.

In another embodiment, a power machine is disclosed. The power machine has a frame and an arm operably coupled to the frame. An implement attachment apparatus is attached to the arm for accepting a primary implement on the arm and an implement carrier is attached to the arm for accepting a second implement. The implement carrier includes a mounting structure that is configured to receive the second implement in either first position or a second position. The received second implement is oriented with a different attitude in the second position with respect to the mounting structure than in the first position.

In yet another embodiment, a power machine is disclosed. The power machine has a frame, with a lift arm mounted to the frame and an implement carrier pivotally coupled to the lift arm. An actuator is coupled to the lift arm and the implement carrier selectively pivots the implement carrier with respect to the lift arm in a first operating mode and allows the implement carrier to float with respect to the lift arm in a second operating mode.

This Summary and the Abstract are provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Before any embodiments are explained in detail, it is to be understood that the concepts discussed in the embodiments set forth herein are not limited in their application to the details of construction and the arrangement of components set forth in the following description or illustrated in the following drawings. The terminology used herein is for the purpose of description and should not be regarded as limiting. The use of "including," "comprising," or "having" and variations thereof herein is meant to encompass the items listed thereafter and equivalents thereof as well as additional items.

The embodiments discussed below are directed toward power machines, implement carriers on power machines, and implements that can be coupled to the disclosed implement carriers. Implement carriers of the type discussed herein are implement attachment apparatuses that have a mounting structure to which various different types of implements can be attached. Implement carriers that are attached to lift arms allow for increased flexibility over traditional implement attachment apparatuses that require that an implement attached directly to a lift arm. Because implements attached to lift arms are often advantageously employed by manipulating the implement relative to the lift arm (such as, for example, rotating a bucket to dig or dump material), it is almost always necessary to provide an actuator to manipulate the implement. By having an implement carrier capable of being attached to a plurality of different implements, changing from one implement to another can be accomplished with relative ease. For example, machines with implement carriers can provide an actuator between the implement carrier and the lift arm, so that removing or attaching an implement does not involve removing or attaching an actuator from the implement. The implement carrier provides a mounting structure for easily attaching an implement to the lift arm (or other portion of a power machine) that a lift arm without an implement carrier does not have.

Figure 1:
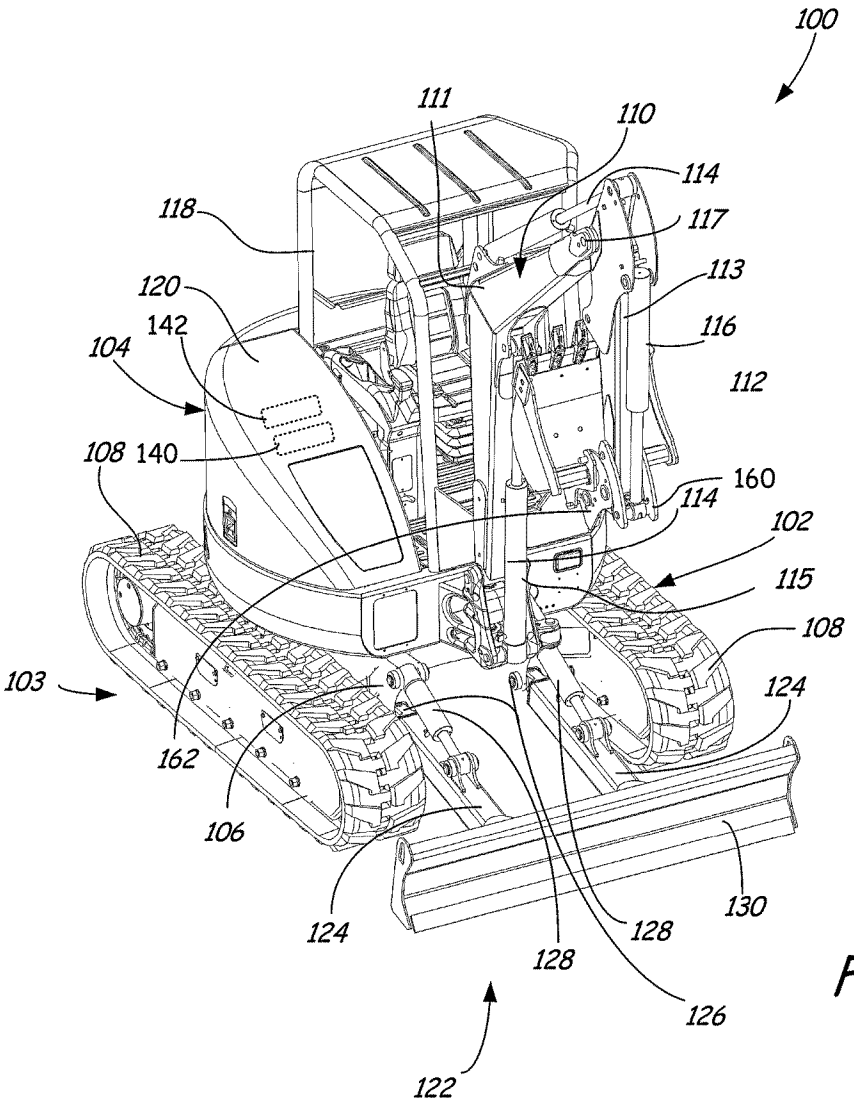
FIG. 1 is a perspective view of a representative power machine on which disclosed embodiments can be practiced.

More particularly, the embodiments discussed below are directed toward power machines that are capable of having a pair of implements simultaneously attached to a single lift arm. The embodiments disclosed below are discussed in terms of a power machine generally and persons of ordinary skill in the art will appreciate that the disclosed embodiments can be practiced on any of a variety of different power machines or even implements that are attachable to power machines. For the purposes of this discussion, a representative power machine on which the embodiments are practiced is illustrated in FIG. 1 and discussed below. For the sake of brevity, only a single representative environment, in the form of an excavator, is discussed, although, as discussed above, the embodiments can be practiced in a variety of environments including on various power machines and implements.

FIG. 1 illustrates a perspective view of a representative power machine 100 that can employ the disclosed embodiments. The power machine 100 illustrated in FIG. 1 is a self-propelled power excavator, but other types of power machines such as skid-steer loaders, tracked loaders, steerable wheeled loaders, including all-wheel steer loaders, telehandlers, walk-behind loaders and utility vehicles, to name but a few examples of power machines with lift arms that are configured to carry implements that may employ the disclosed embodiments. Furthermore, implements that are attachable to a power machine may also employ the disclosed embodiments. Power machine 100 has a frame 102 including a chassis or undercarriage 103 and an upper frame 104 that is rotatably mounted on the undercarriage. Undercarriage 103 includes a lower frame 106 and a pair of support surface engaging track assemblies 108 that are attached to the lower frame 106 and driven with a suitable drive arrangement, such as one or more with hydraulic drive motors.

Upper rotatable frame 104 supports a pivotally mounted two-section lift arm structure 110 that includes both a boom section 111 and an arm section 113, capable of having an implement 112 (a backhoe-style bucket is shown in FIG. 1) attached to an outer end thereof. For the purposes of this discussion, a lift arm structure refers to a pivotable structure attached to a frame and capable of movement relative to the frame for the purposes of positioning an attached tool or implement. In the case of power machine 100, a specific type of lift arm is disclosed, namely, a two-section boom and arm configuration in which each section is moveable. Other power machines such as loaders, to name one example, can have different lift arm structures that fit within the scope of the phrase lift arm structure as used here. The boom section 111 and arm section 113 of lift arm structure 110 are illustratively selectively powered by actuators shown generally at 114 for moving the respective sections 111, 113 about horizontal pivots 115, 117. An implement carrier 162 is pivotally coupled to the lift arm structure 110 and is configured to accept and secure an implement such as implement 112 to the lift arm structure 110. Implement carrier 162 is also selectively powered by an actuator 116 to allow for pivotable movement with respect to the lift arm structure 110. The term implement carrier refers generally to a structure configured to accept and secure an implement to a power machine and more particularly a lift arm structure. An implement attached to an implement carrier should be distinguished from an implement that is attached directly to a lift arm such as by being pinned to the end of a lift arm. Implements can be pinned or otherwise attached to an implement carrier, and the implement carrier is attached to the lift arm structure. In most instances, the implement carrier is pivotally attached to the lift arm. Upper rotatable frame 104 also includes an operator compartment 118 and a housing 120 for an engine for providing power to the suitable drive arrangement that drives the pair of ground engaging track assemblies 108. A plurality of actuable input devices (not shown in FIG. 1) are positioned within the operator compartment 118 to allow an operator to control functions of the machine including, for example, the drive function, manipulation of the lift arm structure 110, and the implement carrier 162.

The power machine 100 illustrated in FIG. 1 also includes a second lift arm structure 122 that is operably coupled to the lower frame 106. The second lift arm structure 122 illustratively includes a pair of lift arms 124 that are rotatably coupled to the lower frame 106 at pivot points 126. A pair of actuators 128 are also coupled to the lower frame 106 and lift arms 124. A blade implement 130 is an illustrative example of an implement that can be coupled to the lift arm structure 122. Other implements can be attached to the lift arm structure 122, including implements such as a pivoting blade that can be pivoted or angled with respect to the lift arm structure 122. Alternatively still, an implement carrier can be attached to the lift arm structure 122 to accept various implements. An example of such an implement carrier is illustrated in U.S. Pat. No. 8,024,875 of Wetzel et al., incorporated herein by reference. The actuators 128 are capable of rotating the lift arm structure 122 with respect to the lower frame 106 to raise and lower the blade implement 130. While FIG. 1 shows two actuators 128, alternatively, a single actuator may be employed to control the angular position of the lift arm structure 124 with respect to the lower frame 106.

Power machine 100 includes a power source 140 in the form of an internal combustion engine. Other power machine can incorporate other power sources including electrical power systems or a hybrid power system such as one that includes an electrical power source and an internal combustion engine. The power source 140 is operably coupled to a power conversion system 142 that receives power from the power source 140 and control signals from operator input devices to convert the received power to operational signals that operate functional components of the power machine. The power conversion system 142 of representative power machine 100 includes hydraulic components including a plurality of hydraulic pumps (not shown) that are configured to provide pressurized hydraulic fluid to valve components (not shown) that control the flow of hydraulic fluid to various actuators used to control functional components of the power machine 100. Other power machines can include various combinations of pumps, valve components, and actuators, including machines with hydrostatic drive systems. Still other power machines can include other, non-hydraulic components to convert power from a power source including gear reductions, clutches, drive trains, power takeoffs, and electric generators, to name a few.

Among the functional components that receive signals from the power conversion system 142 are tractive elements 108, illustratively shown as track assemblies, which are configured to rotatably engage a support surface to cause the power machine to travel. In other embodiments, such as certain loader embodiments employing a backhoe implement or other excavators, the tractive elements can be wheels. In an example embodiment, a pair of hydraulic motors (not shown in FIG. 1), are provided to convert a hydraulic power signal into a rotational output for left and right sides of the machine. In other embodiments, differing numbers of hydraulic motors can be employed. Other functional components include the lift arm structure 122.

Figure 2:
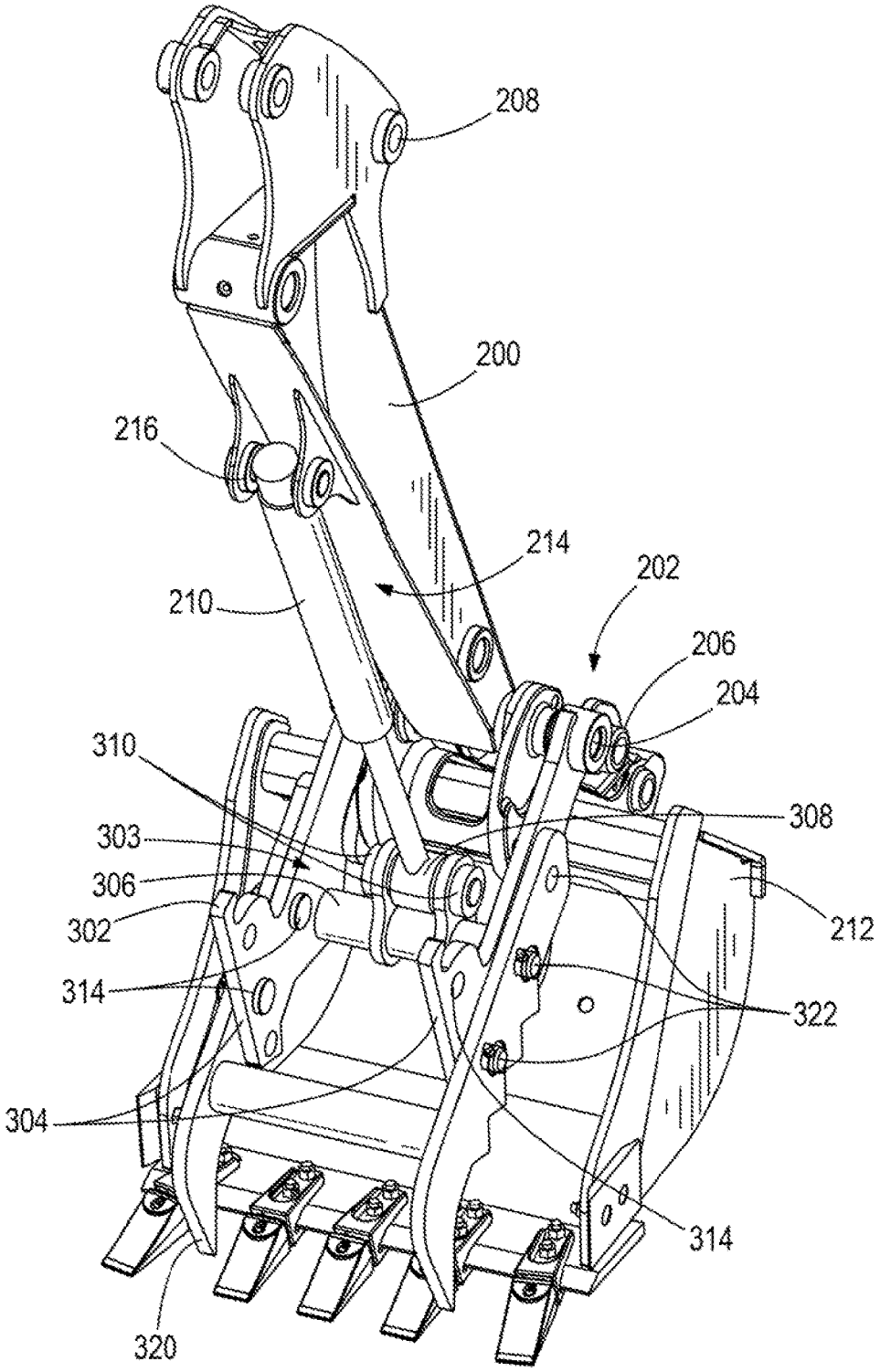
FIG. 2 is an illustration of a thumb implement assembly coupled to a lift arm similar to that of the representative power machine of FIG. 1 according to one illustrative embodiment.
Figure 3:
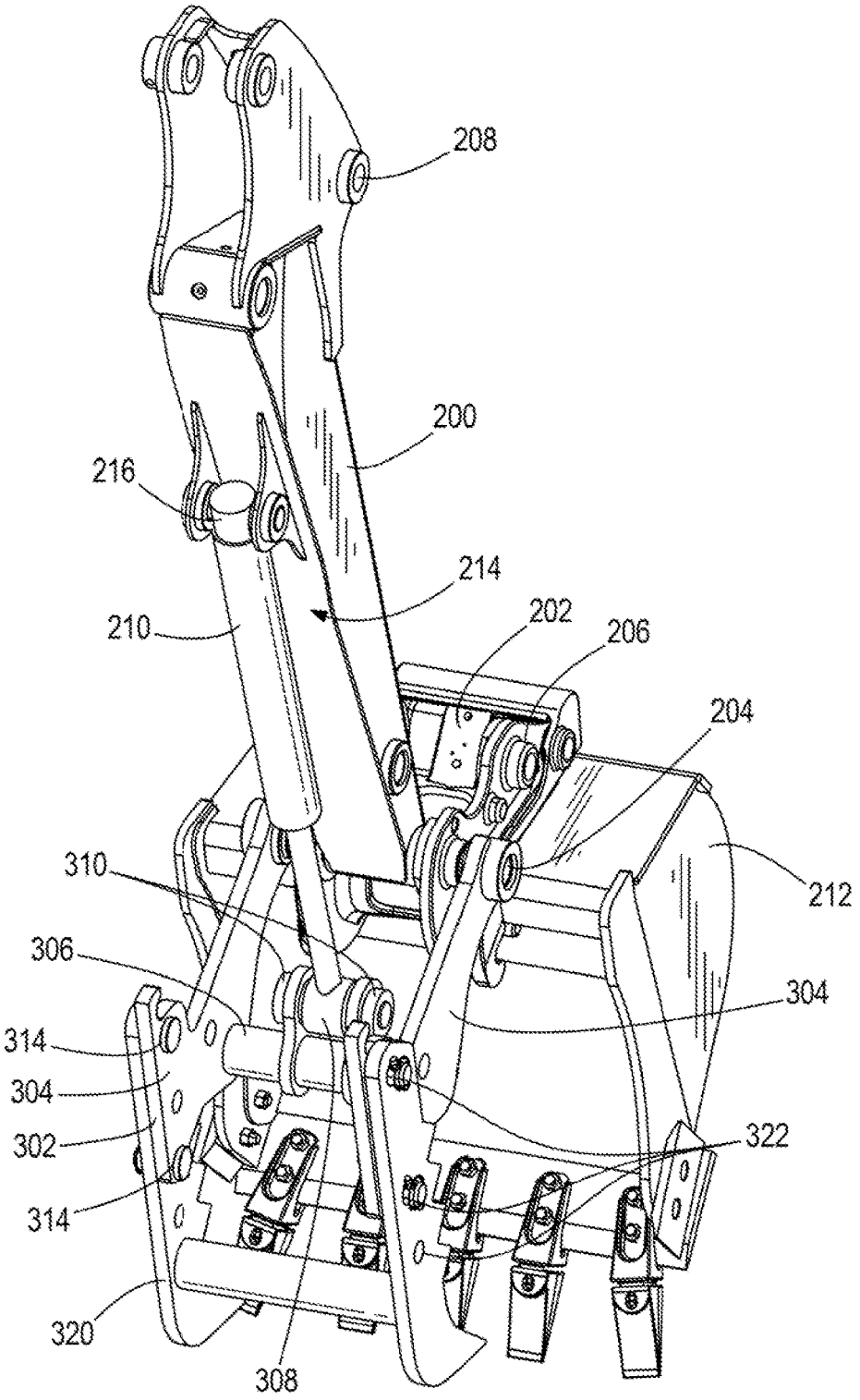
FIG. 3 is an illustration of the thumb implement assembly shown in FIG. 2, with a thumb implement attached to a thumb implement carrier in a different orientation from that shown in FIG. 2.

Referring now to FIGS. 2-3, an implement carrier 302 that is capable of receiving thumb implements is pivotally mounted on an arm section 200 of a lift arm structure similar to lift arm structure 110 that also has an implement carrier 202 pivotally attached to the arm section at pivot joint 204 according to one illustrative embodiment. The concepts discussed in the embodiments discussed below are directed toward an implement carrier such as implement carrier 302 that is capable of accepting a plurality of different implements designed to operate as a thumb implement. In addition, the concepts discussed below include features for implement carriers in general, especially as it relates to attaching a given implement in various different positions with respect to the implement carrier. More particularly, the concepts include mounting features on the implement carrier that allow for different angular relationships or attitudes (i.e. orientations) between the implement carrier and an implement mounted thereon. Additional concepts include the combination of an implement carrier and an implement attached to the implement carrier as well as an environment in which such a combination can be advantageously employed.

An actuator similar to actuator 116 in FIG. 1 (removed from FIGS. 2-3 for simplicity sake) is operably coupled to the implement carrier at pivot joint 206 and to the arm section at pivot joint 208 such as through a link similar to link 160 shown in FIG. 1. For purposes of this discussion, the implement carrier 202 is referred to as a first or primary implement carrier and any implement attached thereto is a primary implement. Implement 212, in this embodiment, is a primary implement in the form of a backhoe bucket attached to the primary implement carrier 202. Extension and retraction of the actuator attached at pivot joints 206 and 208, in response to operator-controlled input devices, causes the primary implement carrier 202 and the attached implement 212 to pivot about pivot joint 204. It should be appreciated that various different implements can be attached and secured to the implement carrier 202 as may be advantageous for use in various work applications. While the embodiment shown in FIGS. 2-3 includes primary implement carrier 202, in some embodiments, a primary implement is attached directly to the arm without a primary implement carrier.

The thumb implement carrier 302 has a mounting structure 303 that is pivotally mounted to the arm section 200 at pivot joint 204 so that the thumb implement carrier pivots about the same axis as the implement carrier 202, although in some embodiments the thumb implement carrier is mounted to pivot about a different axis than the primary implement carrier 202, or in the case of those embodiments without a primary implement carrier the thumb implement carrier can be mounted to pivot about a different axis than the primary implement. The mounting structure 303 as shown has first and second sides in the form of a pair of plates 304 that are positioned generally parallel with respect to one another with a cross member 306 positioned between and attached to each of the plates 304. The cross member 306 is, in one embodiment, a tube having one of the plates 304 attached to each end thereof. The plates 304 and the cross member 306 can be individual components fastened together such as by welding. In some embodiments, some or all of the components that are described herein as being part of the mounting structure 303 of thumb implement carrier 302 are part of a single casting or molded component. Actuator 210 is pivotally mounted on an underside 214 of the arm section 200 at pivot joint 216 and to the cross member 306 of thumb implement carrier 302 of the thumb at pivot joint 308. As shown in FIGS. 2 and 3, pivot joint 308 extends through a pair of tabs 310 that extend from cross member 306 that serve as an exemplary mounting feature for the actuator 210. Actuator 210 is actuable in response to signals provided by manipulation of operator control devices such as those in an operator compartment. Extension and retraction of actuator 210 causes the thumb implement carrier 302 to rotate about pivot 204 and, by extension toward and away from the implement 212. As discussed in more detail below, in some embodiments, actuator 210 can be placed into a float position to allow the thumb implement assembly to move according to gravity in certain situations.

The thumb implement carrier 302 is capable of accepting any of a number of different types of thumb implements. In FIGS. 2-3 one example of such a thumb implement 320 is shown. The thumb implement 320 shown in FIGS. 2-3 is a two-tined implement that is configured to interact with the exemplary backhoe bucket implement 212 to provide a grapple type clamp between the backhoe bucket implement and the thumb implement. While FIGS. 2-3 show the thumb implement 320 in cooperation with a backhoe bucket implement, the implement 320 can cooperate with other implements and other thumb implements and implements in combination therewith are contemplated. The thumb implement 320 has a number of mounting features 322 that are configured to be attached to mounting features 314 on the plates 304 of the thumb implement carrier 302. Each of the plates 304 have a plurality of mounting features 314 arranged thereon to allow for attachment of the thumb implement 320 in a plurality of orientations with respect to the thumb implement carrier 302. In one embodiment, two of the mounting features 322 on the thumb implement 320 are aligned and engaged such as with pins to two of the mounting features 314 on each of the plates 304. Since in some embodiments, there are more mounting features on each of the thumb implement carrier 302 and the thumb implement 320 than are intended to be aligned and connected, selection of various mounting features for mounting will provide the possibility of different mounting orientations of a thumb implement with respect to the thumb implement carrier as demonstrated in the two different mounting orientations of implement 320 on thumb implement carrier 302 shown in FIGS. 2 and 3.

Figure 4:
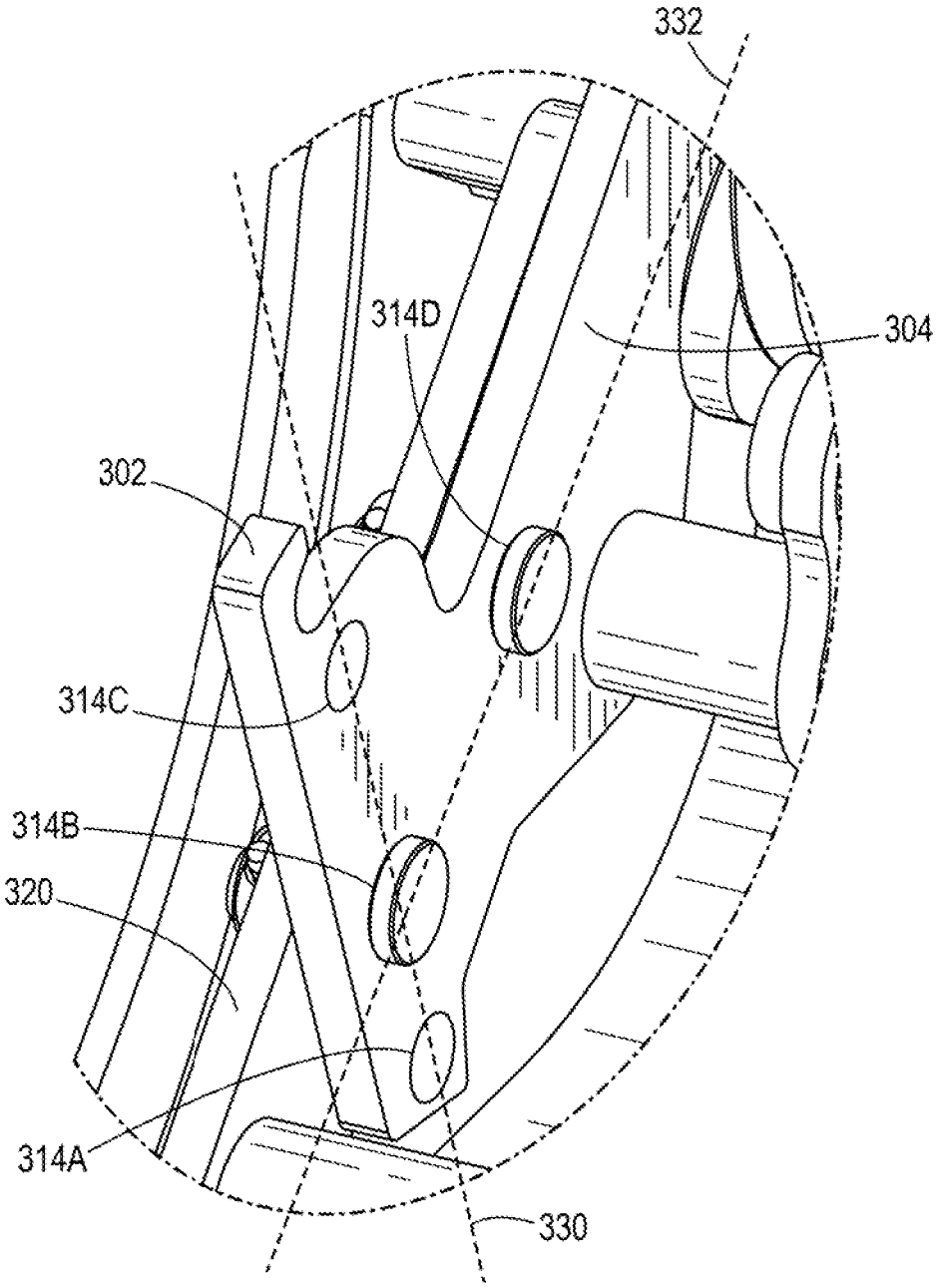
FIG. 4 is an illustration of part of the thumb implement carrier of FIG. 3, showing an arrangement of mounting features thereon.

FIG. 4 illustrates a part of the thumb implement carrier 302, showing mounting features on one of the plates 304. For this portion of the discussion, it is assumed than an implement is fixedly attached to at least two mounting features on each plate 304, although, as is discussed below, in other embodiments, that need not be the case. The mounting features in plate 304 are apertures configured to be aligned with features on a thumb implement 320. In one embodiment, the mounting features on a thumb implement are similarly sized apertures so that alignment can be achieved between two apertures on the thumb implement 320 and the thumb implement carrier 302 so that pins can be inserted into the apertures to secure the thumb implement 320 to the plate 304. Other mounting features besides the apertures shown are contemplated.

Figure 5:
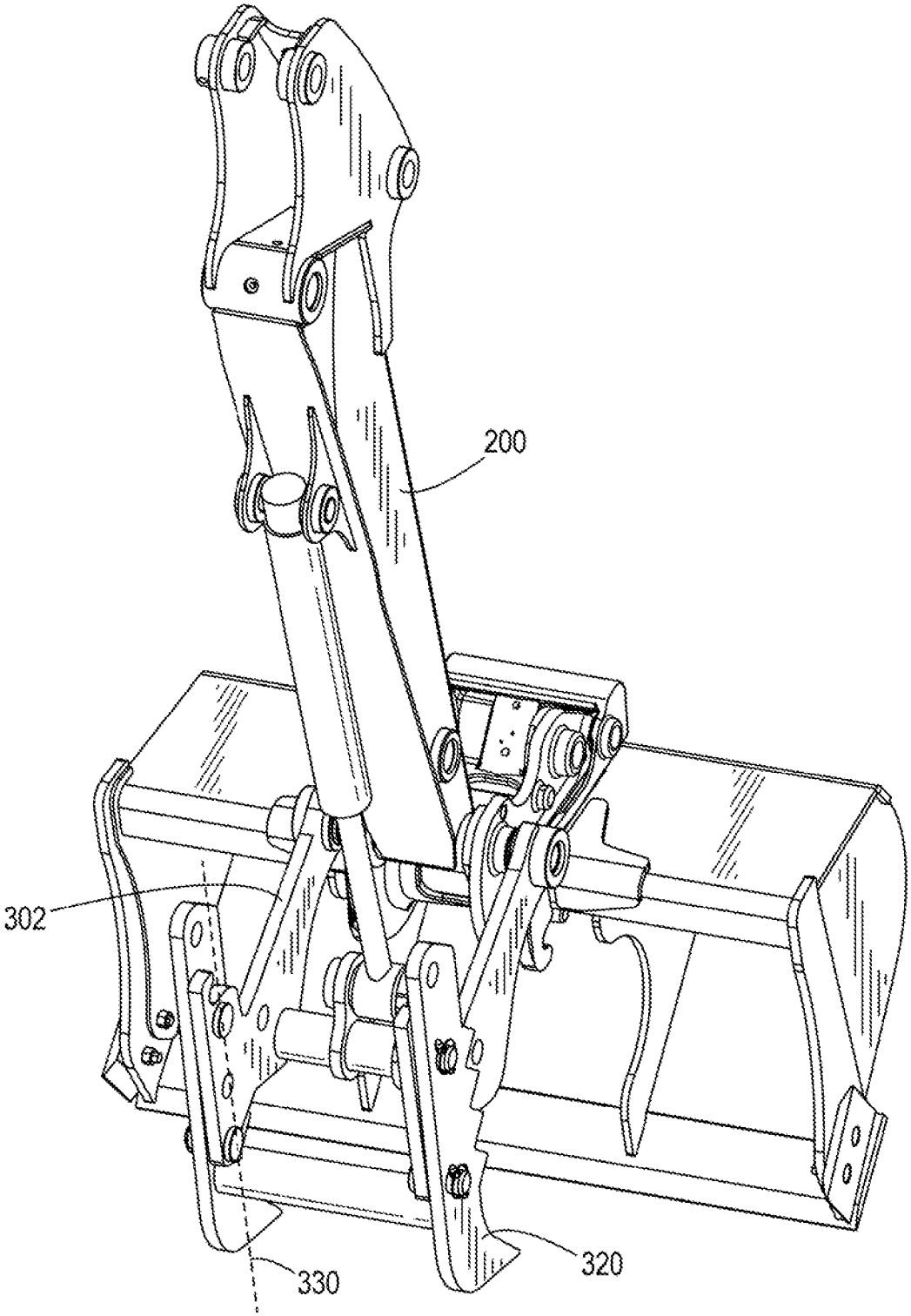
FIG. 5 is an illustration of the thumb implement assembly shown in FIG. 2, with the thumb implement attached to the thumb implement carrier in yet another orientation.

Mounting features 314A, 314B, 314C, and 314D are spaced so that a thumb implement can be aligned with two of these four features in two different arrangements. Because the mounting features are not in a single line, the orientation of the thumb implement can be selected from a number of different arrangements. A first arrangement involves selection of mounting features 314A and 314C so that the thumb implement 320 is aligned along an axis 330. This is the arrangement shown in FIG. 3. A second arrangement involves selection of mounting features 314B and 314D so that the thumb implement 320 is aligned along an axis 332. This is the arrangement shown in FIG. 2. In some embodiments, a third arrangement involves selection of mounting features 314C and 314D so that the thumb implement 320 is aligned along an axis that extend through mounting features 314C and 314D. The thumb implement 320 shown in FIGS. 2 and 3 have three mounting features 322 that are substantially in alignment. Selection of two of the features can position the feature along the selected axis as desired. In some embodiments, a particular thumb implement has just two mounting features, so that attachment to a thumb implement carrier is restricted to a given position in a particular orientation or a thumb implement carrier can have any number of additional mounting features to allow for a variety of different positions along a selected axis of attachment. FIG. 5, for example, shows thumb implement 320 secured to the thumb implement carrier 302 in the same orientation (i.e. along axis 330) as is shown in FIG. 4, but uses different mounting features.

Figure 6:
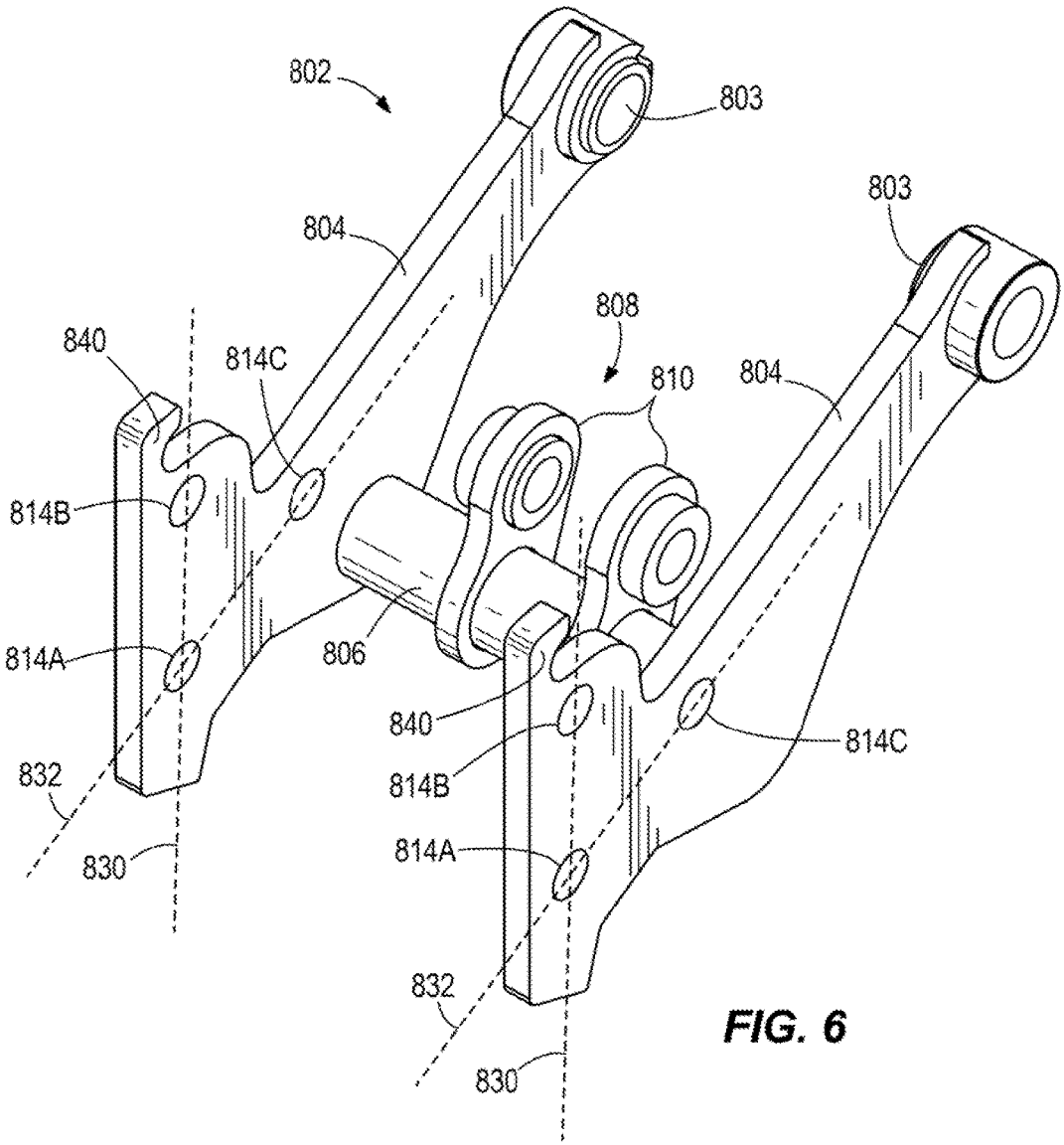
FIG. 6 is an illustration of a thumb implement carrier according to another embodiment.

FIG. 6 illustrates a thumb implement carrier 802 configured to be attached to an arm such as arm 200 according to another illustrative embodiment. Thumb implement carrier 802 includes a pair of plates 804 disposed on either side of, and coupled to, a cross member 806. As discussed in previous embodiments, the plates 804 can be fastened to or integral with cross member 806. The thumb implement carrier 802 is capable of being attached to an arm at attachment points 803. Tabs 810 provide an attachment point 808 for an actuator such as actuator 210. Tabs 810 can be fixed such as by welding to cross member 806 or integral such as being part of a casting. Mounting features 814A, 814B and 814C are provided on each of the plates 804 for accepting a thumb implement in one of two orientations, shown as axes 830 and 832. In the embodiment shown in FIG. 6, the mounting features are arranged so that mounting feature 814A is utilized in each of the orientations. The plates 804 also feature a hook 840 that is advantageously provided to assist in the coupling of a thumb implement to the thumb implement carrier 802. By putting a pin through a mounting feature on each side of the thumb implement and positioning the hooks by actuating an actuator such as actuator 210, the hooks can engage such pins and the lift arm structure and thumb implement carrier can be manipulated to lift a thumb implement into position to mount the thumb implement to the thumb implement carrier 802.

Figure 7:
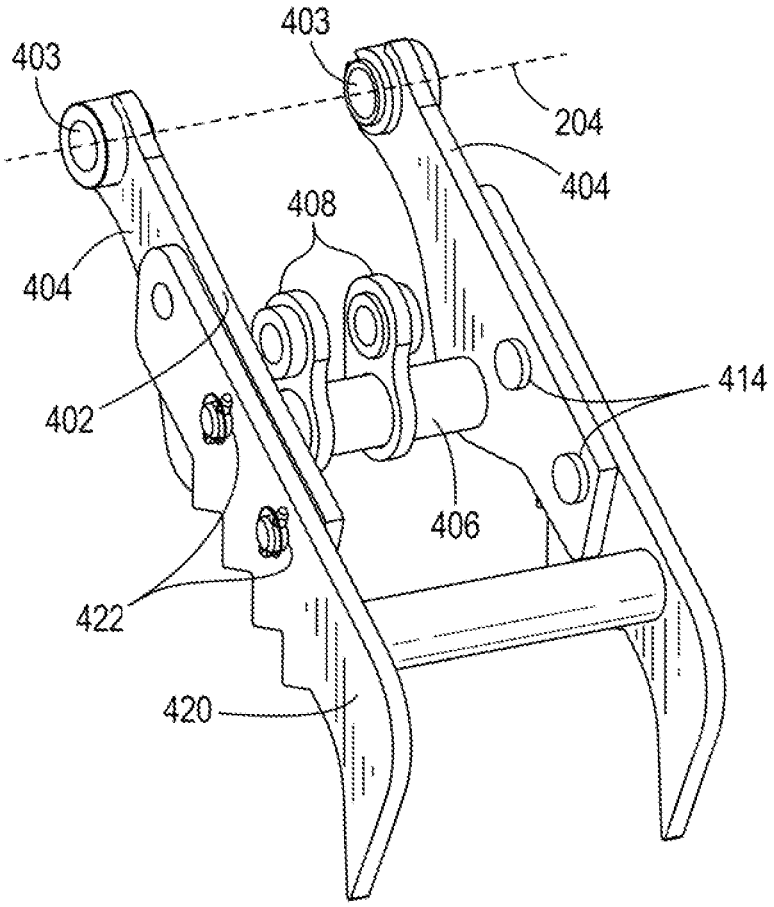
FIG. 7 is an illustration of a thumb implement assembly according to another embodiment.
Figure 8:
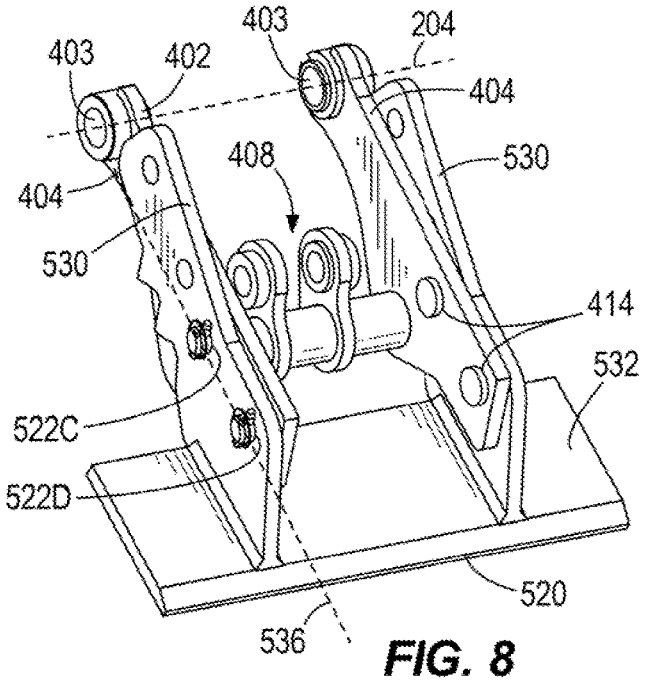
FIGS. 8-9 are illustrations of a thumb implement carrier of FIG. 7 and a thumb implement attached thereto, the thumb implement having mounting features allowing for a plurality of coupling orientations according to another embodiment.
Figure 9:
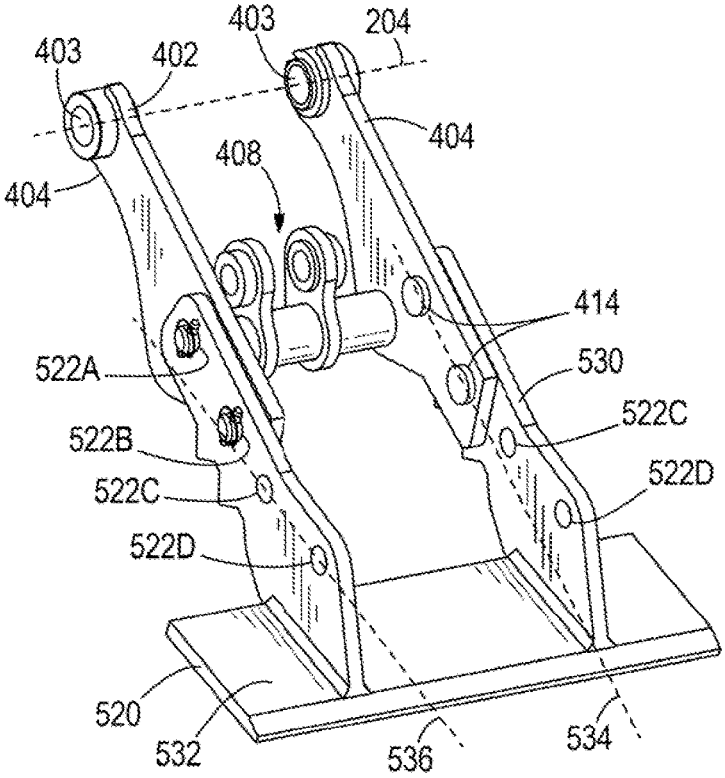

FIGS. 7-9 illustrate a thumb implement carrier 402 capable of being attached to the arm 200 at pivot 204 shown in FIG. 2 (and represented as an axis labeled as 204 in FIG. 7) according to another embodiment. Pivot mounts 403 are provided to be pinned at pivot 204. Thumb implement carrier 402 includes a pair of plates 404 that are spaced apart in a substantially parallel arrangement by cross member 406. Cross member 406 includes actuator mounting features 408 that are configured to accept and be secured to actuator 210. Thumb implement carrier 402 also includes implement mounting features 414 for receiving and being secured to a thumb implement 420. The thumb implement mounting features 414 on thumb implement carrier 402 are substantially inline. A pair of these mounting features 414 are shown on each of the plates 404, but in alternative embodiments any number of additional inline mounting features 414 can be provided. The thumb implement 420 shown in FIG. 7, then is limited to one orientation and position along that orientation with respect to thumb implement carrier 402, as thumb implement 420 has just two mounting features 422 capable of being aligned with each of the two mounting features 414 on the plates 404. In other embodiments, thumb implement 420 can have additional inline mounting features that allow for adjustment of the position of the thumb implement 420 along the orientation established by the mounting features 414.

FIGS. 8-9 illustrate a thumb implement 520 coupled to the thumb implement carrier 402 according to another embodiment. Thumb implement 520 has a pair of mounting brackets 530 that are coupled to a blade 532. Blade 532 can be manipulated to perform a variety of functions, including, for example, urging loose soil into cooperating with an attached bucket, thereby acting somewhat like a broom pushing dirt into a dust pan. When paired with a toothed bucket, it can cooperate with the toothed bucket by being positioned adjacent the teeth to facilitate grading a smooth level without removing the toothed bucket. The geometries of the toothed buckets and buckets without teeth differ such that using a thumb implement 520 on each necessarily requires that the thumb implement 520 be coupled to a thumb implement carrier in different orientations. To account for thumb implement carriers like thumb implement carrier 402 that have mounting features 414 aligned in just one orientation, the thumb implement 520 has mounting features 522 that are not all in a single line. As shown in FIG. 9, mounting features 522A and 522B are aligned along an axis 534 and mounting features 522C and 522D are aligned along an axis 536. As a result, aligning the mounting features 414 on the thumb implement carrier 402 with 522A and 522B aligns the thumb implement 520 along axis 534 (as shown in FIG. 9), while aligning the mounting features 522C and 522D with the mounting features 414 aligns the thumb implement 520 along axis 536 (as shown in FIG. 8). Thus, implement 520 has mounting features that enable different orientations when mounted to the same mounting features of a given implement carrier.

Figure 10:
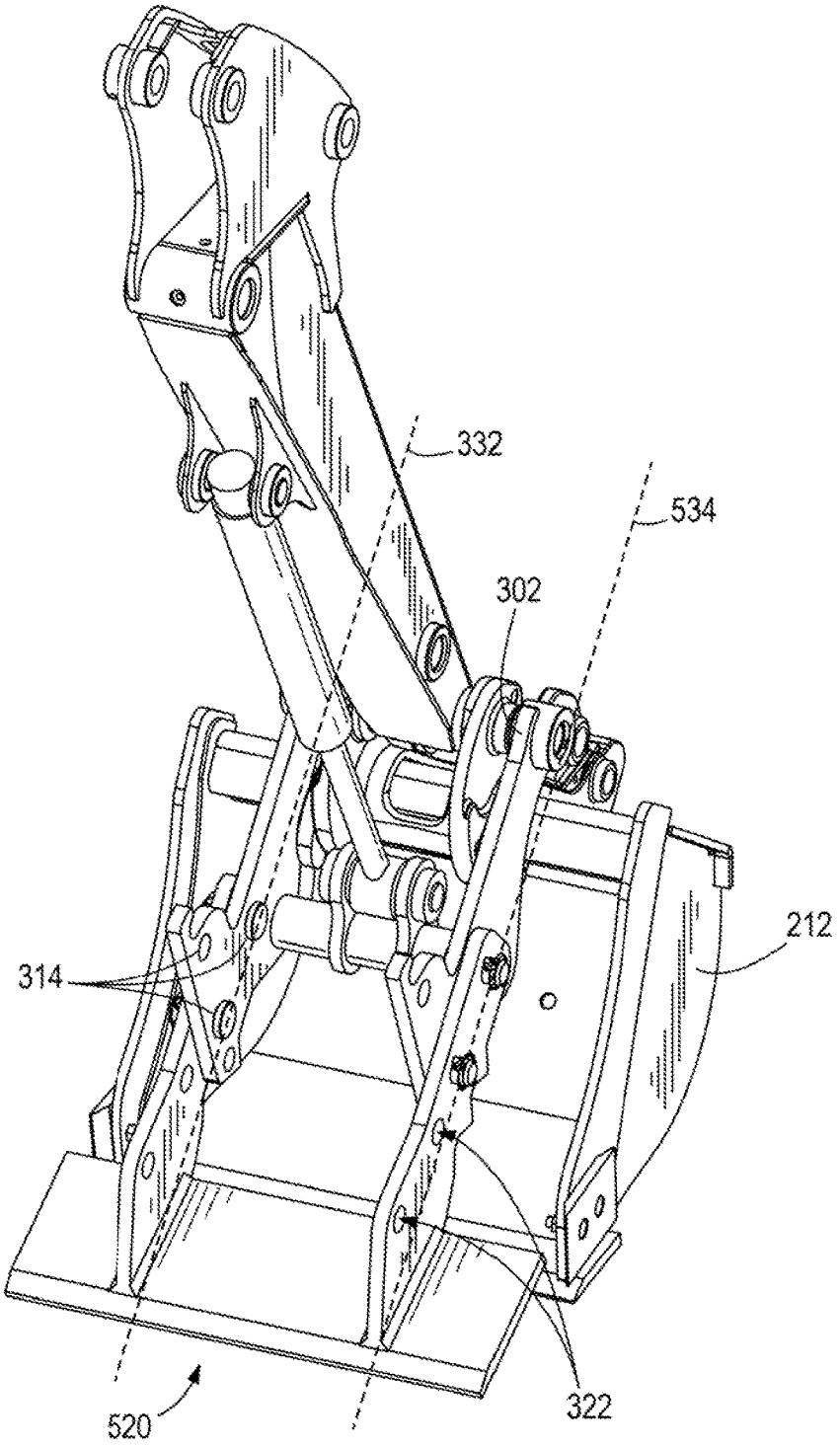
FIGS. 10-11 are illustrations of the thumb implement of FIG. 8 coupled to the thumb implement carrier illustrated in FIG. 2.
Figure 11:
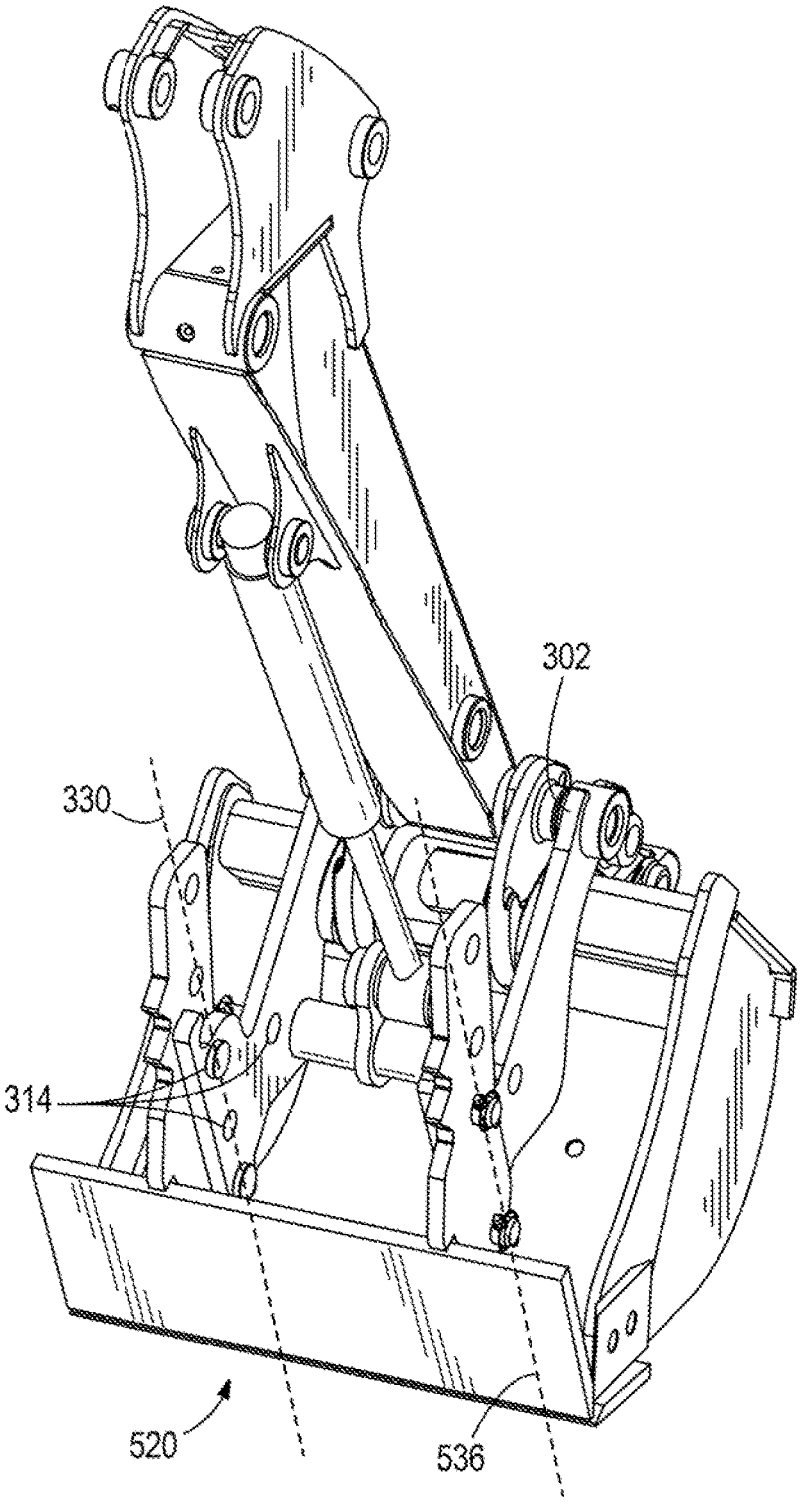

Thumb implement 520 can also be coupled to a thumb implement carrier such as thumb implement carrier 302 that has mounting features 314 that allow for various orientations as well. FIGS. 10-11 show thumb implement 520 coupled to the thumb implement carrier 302. In FIG. 10, the coupling between the thumb implement carrier 302 and the thumb implement 520 is along the axis 332 on the thumb implement carrier (as shown in FIG. 4) and axis 534 on the thumb implement 520 (as shown in FIG. 10). In FIG. 11, the coupling between the thumb implement carrier 302 and the thumb implement 520 is along the axis 330 on the thumb implement carrier and axis 536 on the thumb implement 520. These examples illustrate the flexibility that can be achieved in attaching a thumb implement to a thumb implement carrier when each of the thumb implement carrier and the thumb implement allow for multiple orientations.

Figure 12:
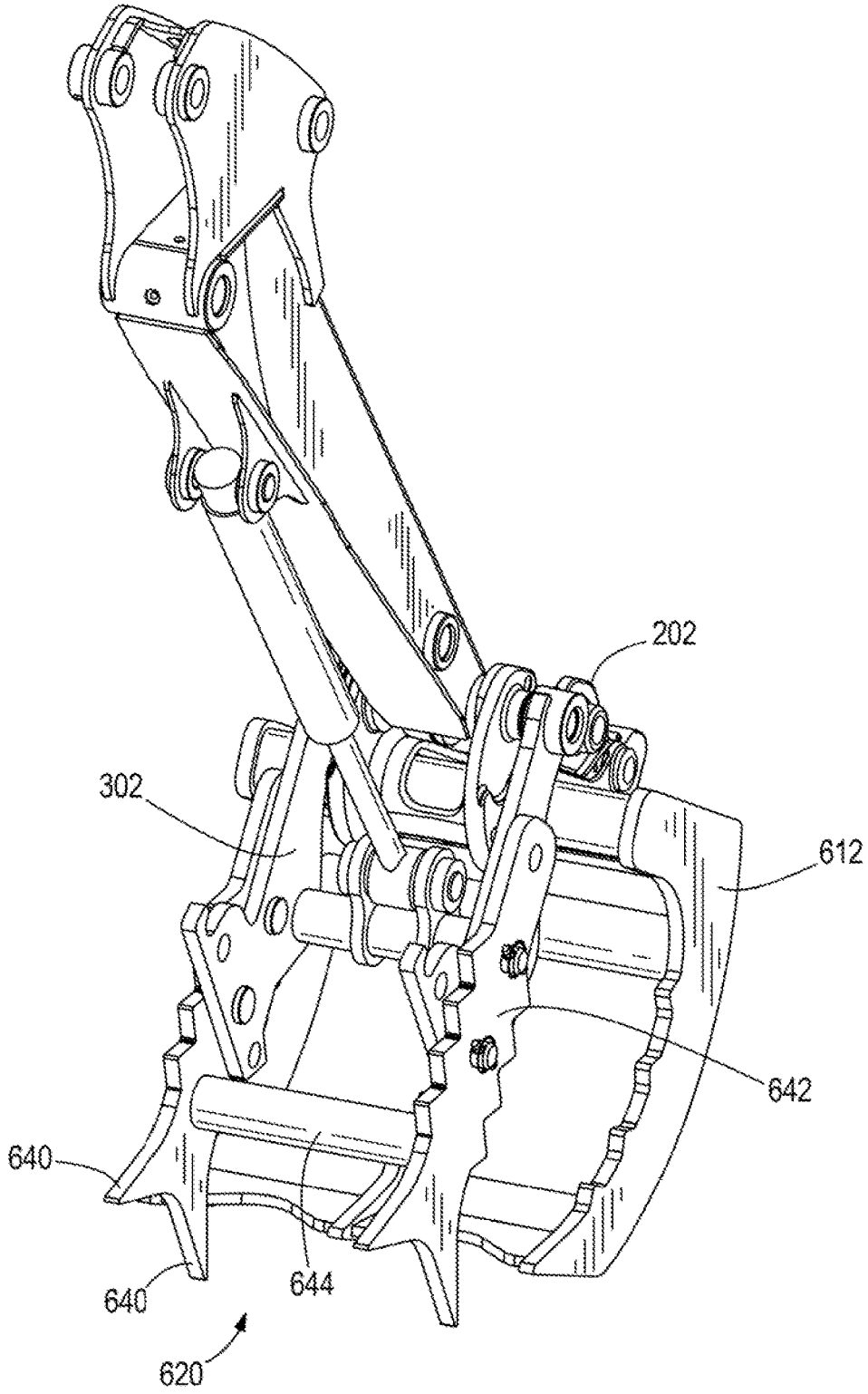
FIG. 12-14 are illustrations of additional embodiments of thumb implements mounted to the thumb implement carrier of FIG. 2.
Figure 13:
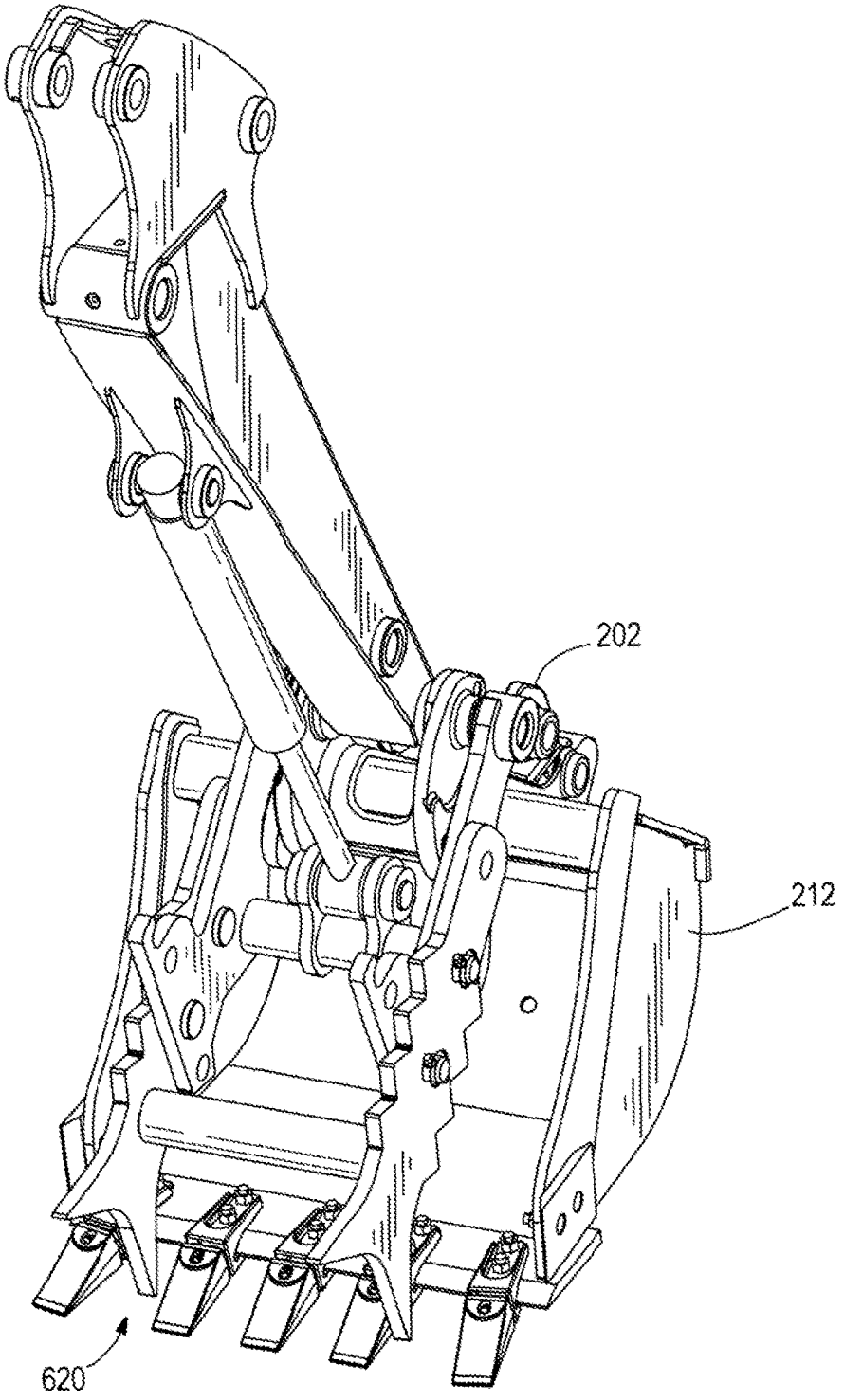
Figure 14:
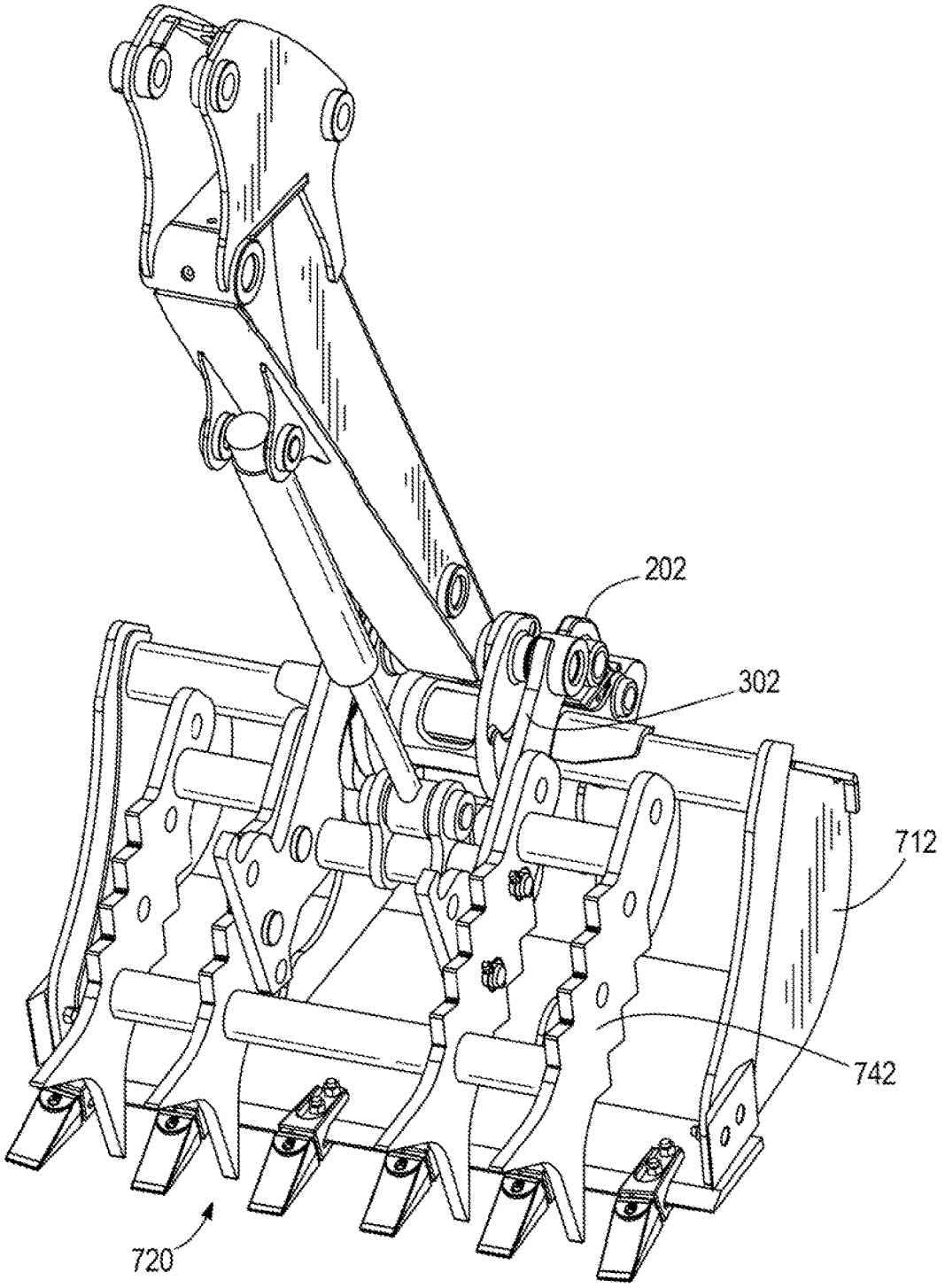

FIGS. 12-14 illustrate some additional thumb implements and implement arrangements. In FIG. 12 a dual edge thumb implement 620 is disclosed. Thumb implement 620 is secured to thumb implement carrier 302 and a grapple implement 612 is secured to the implement carrier 202. The dual edge thumb implement 620 has generally straight tines 642 that are attached to a cross member 644. Each of the tines 642 has an edge 640 capable of engaging soil or other materials. The thumb implement 620 can be attached so that when one set of the edges 640 is worn, the thumb implement 620 can be reversed and the other set of edges 640 can be utilized. FIG. 13 shows the same thumb implement 620 with a bucket implement 212. FIG. 14 shows dual edge thumb implement 720 with four tines 742 attached to the thumb implement carrier 302. A wider bucket implement 712 is secured to the implement carrier 202.

Figure 15:
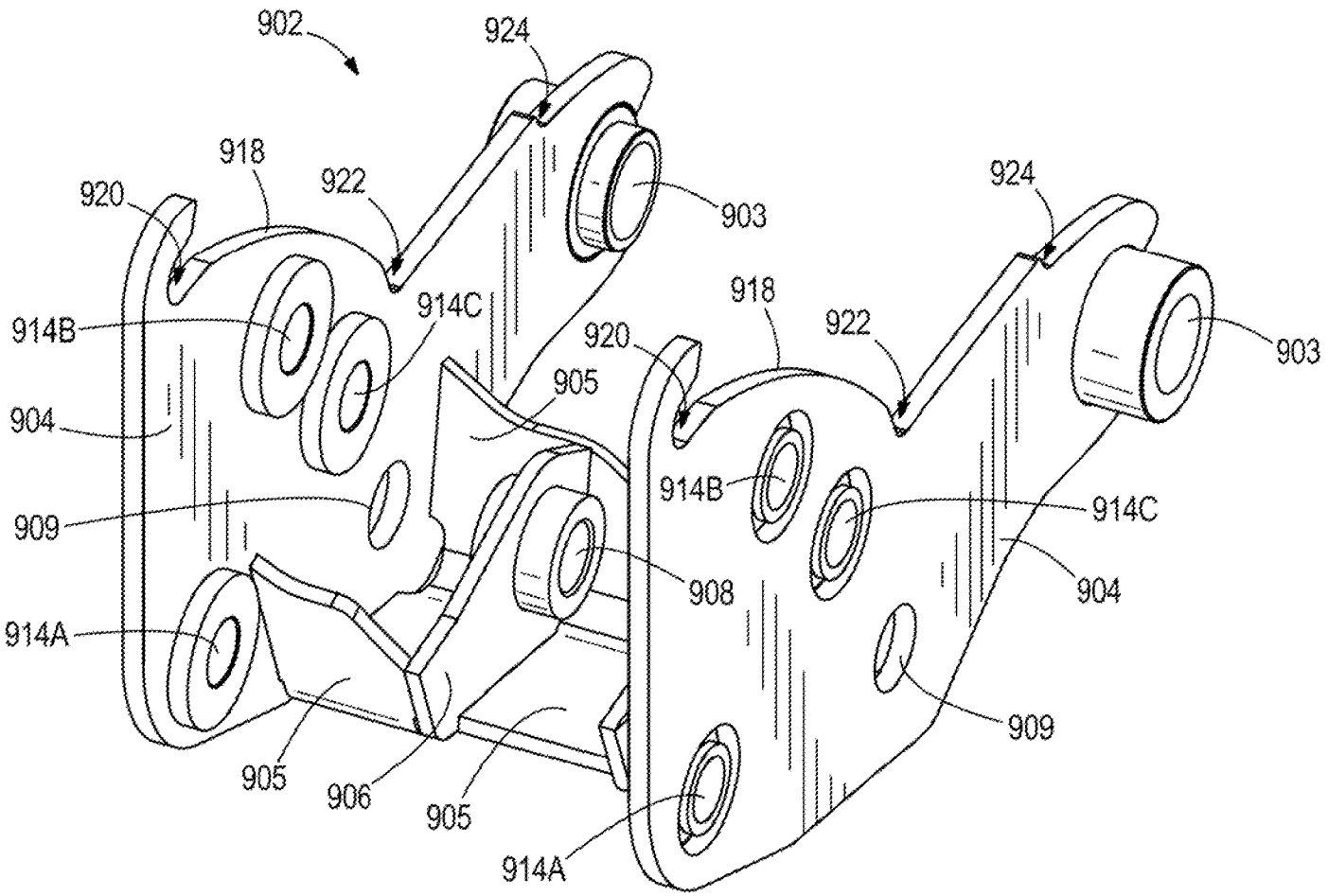
FIG. 15 illustrates a thumb implement carrier according to an alternative embodiment.
Figure 16:
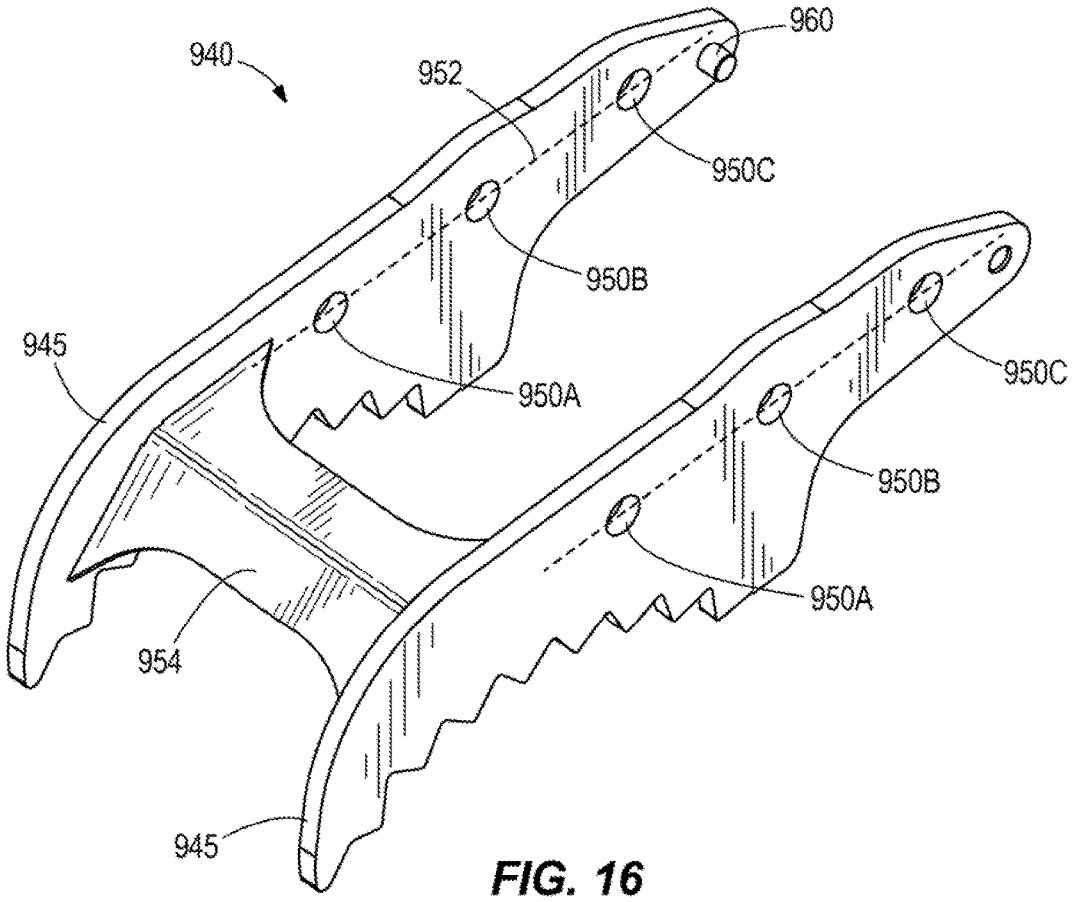
FIG. 16 illustrates an exemplary embodiment of thumb implement configured to be mounted to thumb implement carriers of the type discussed in the illustrative embodiments.
Figure 17:
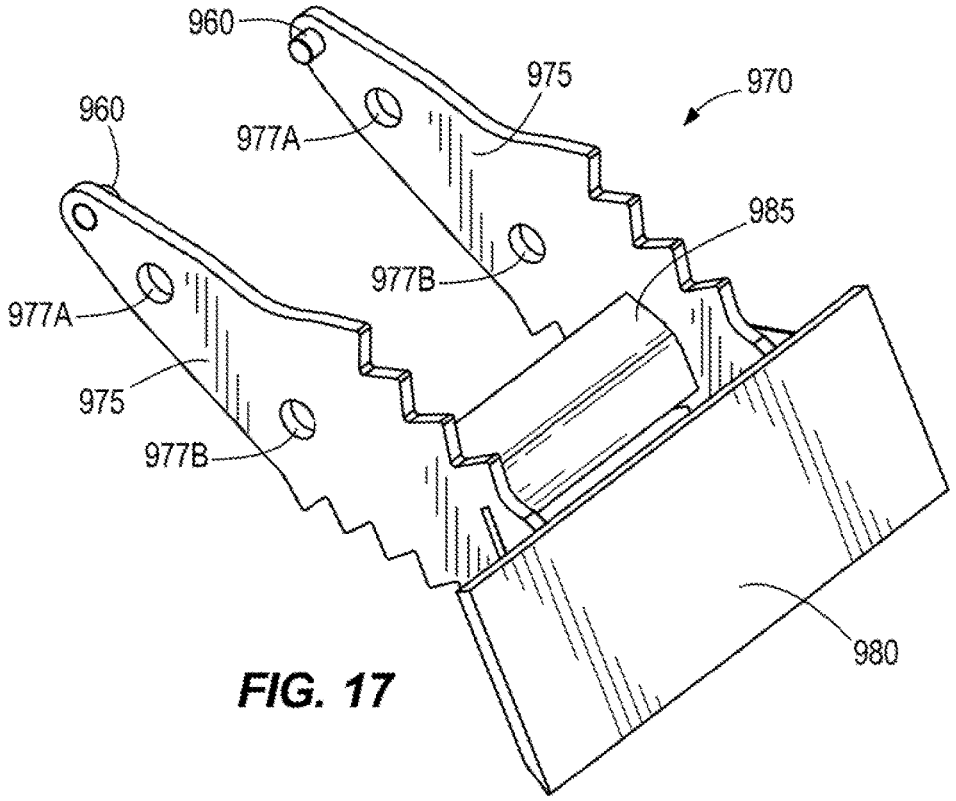
FIGS. 17 and 18 illustrate another illustrative embodiment of a thumb implement configured to be mounted to thumb implement carriers of the type discussed in the illustrative embodiments.
Figure 18:
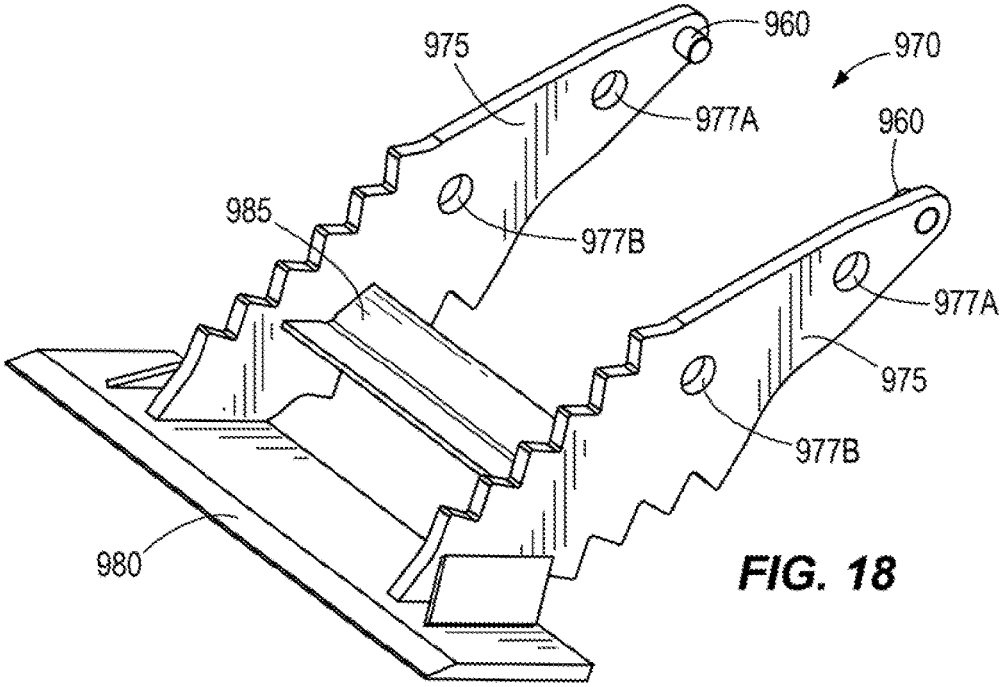

Referring now to FIG. 15, shown is an alternate embodiment of a thumb implement carrier 902 that can be used with the thumb implements described above and with alternate thumb implement configurations such as those shown in FIGS. 16-18. Thumb implement carrier 902 is somewhat similar to thumb implement carrier 802 described above, but thumb implement carrier 902 has some additional and different features. Similar to thumb implement carrier 802, thumb implement carrier 902 has a mounting structure that includes a pair of main plates 904 arranged generally parallel to each other in exemplary embodiments. Arm attachment points or pivot mounts 903, which are substantially similar to corresponding mount mechanisms 204, 403, and 803, are included near one end of each main plate for securing thumb implement carrier 902 to an arm of the machine. One or more cross plates 905 are oriented generally perpendicular to main plates 904, and extend either from one main plate 904 to the other or from one main plate 904 to a center plate or tab 906. Center plate 906 is, in exemplary embodiments, generally parallel to main plates 904, and provides an attachment point or mechanism 908 (e.g., similar to 808) for attaching to one end of an actuator (e.g., for accepting an end of the cylinder 210). In some embodiments, apertures 909 are provided in each of main plates 904 and are aligned with attachment point 908 to allow for insertion or removal of a pin extending between the main plates and through attachment point 908 to secure the actuator to the thumb implement carrier 902.

Thumb implement carrier 902 has a contoured surface 918 on each of main plates 904 that is designed to accept pegs 960 from a thumb implement (shown in FIGS. 16-18) to aid in aligning apertures on the thumb implement with two of the three apertures 914A, 914B, and 914C in each of the main plates. In an exemplary embodiment, there are three locations 920, 922 and 924 along contoured surface 918 that are shaped or configured to act as positioning stops to accept the pegs 960. In alternate embodiments, additional positioning stops and mounting apertures can be formed into the main plates to allow for additional mounting configuration as may be advantageous.

By selectively positioning a thumb implement relative to the thumb implement carrier 902 so that pegs 960 are in engagement with the thumb implement carrier at one of the first, second, and third stop positions 920, 922 and 924, mounting thumb implements to the thumb implement carrier in various different orientations is facilitated. The pegs 960 support some of the weight of the implement when the pegs are positioned in one of the stops, making rotating the thumb implement into position for attachment to the thumb implement carrier easier. Once a first mounting pin or pins (not shown) are inserted into corresponding ones of apertures 914A, 914B, or 914C (in most embodiments, a first mounting pin is inserted into aperture 914A) on each of the main plates 904 and aligned apertures on a thumb implement, the thumb implement carrier 902 supports the thumb implement. An operator can then more easily rotate the thumb implement into alignment as may be necessary and the second pins can be inserted into the corresponding other set of apertures 914A, 914B or 914C (in most embodiments either of 914B or 914C) and aligned apertures on the thumb implement, depending on the desired configuration of the thumb implement. It should be appreciated that it may not be desirable to attach every thumb implement to the thumb implement carrier in every orientation. Thus, in some embodiments, the alignment of the apertures in the thumb implement carrier and the thumb implements are designed to prevent attachment of the thumb implement to the thumb implement carrier in certain positions that may not be advantageous. In some embodiments, the mounting pins are shaped to allow for insertion in only one orientation, such as through apertures in the thumb implement carrier and then the thumb implement or vice versa.

Referring now to FIG. 16, shown is an exemplary embodiment of a thumb implement 940 that is configured to couple to thumb implement carrier 902 shown in FIG. 15. Thumb implement 940 includes a pair of mounting plates 945 arranged generally parallel to each other, and a cross plate or member 954 extending between the mounting plates 945. Each of the mounting plates 945 includes three apertures 950A, 950B, and 950C, and pegs 960 (only one is shown in FIG. 16). The pegs 960 can ride along the contoured surfaces 918 of the thumb implement carrier and, when positioned in one of the stop locations 920, 922, and 924, help to position the apertures 950A, 950B and 950C to match with the various combinations of apertures 914A, 914B, and 914C in the thumb implement carrier to achieve the desired configuration. In FIG. 16, a line 952 is shown running through a center of each of apertures 950A and 950C, although in some embodiments, the apertures need not be aligned, which can advantageously allow for different attitudes or angles of attachment to an implement carrier. Peg 960 is slightly offset from line 952. This arrangement prevents the thumb implement 940 from being attached to thumb implement carrier 902 because the pegs 960 engage with the contour to prevent insertion of a second pin to secure the thumb implement fixedly to the thumb implement carrier 902. This advantageously prevents a user from incorrectly mounting a thumb implement in a position or orientation that might, for example cause the thumb implement to contact the arm to which the thumb implement carrier 902 is attached in an undesirable way. Alternatively, on thumb implements where such potential issues would not arise, it would not be necessary to align the apertures as discussed above to prevent attachment in certain configurations.

When the pegs 960 are positioned against stop 920, the thumb implement 940 can be rotated until aperture 950B is aligned with aperture 914A and a mounting pin can be inserted through each. However, in this position, aperture 950C aligns with aperture 914B but does not line up with aperture 914C, thereby precluding an attachment in this position at least on thumb implement carrier 902. In other embodiments, other thumb implement carriers may accept alignment of the aperture 950B with aperture 914A and aperture 950C with the aperture 914B or with the aperture 914C. This allows the same thumb implements to be used on machines with different sized thumb implement carriers. When the pegs 960 are positioned against stop 922, the thumb implement 940 can be rotated until aperture 950B is aligned with aperture 914A and a mounting pin can be inserted through each. The thumb implement 940 can then be rotated so that aperture 950C can be aligned with aperture 914C. When the pegs 960 are positioned against stop 924 and aperture 950A is aligned with aperture 914A, the thumb implement can be rotated so that aperture 950B can be aligned with either aperture 914B or 914C. The configuration of apertures 950A, 950B, and 950C can be selected in the design phase to give an operator the ability to vary the attitude of the thumb implement with respect to the thumb implement carrier for various tasks or to conform to the geometries of various sized implements such as backhoe buckets.

Referring now to FIGS. 17 and 18, shown are first and second perspective views, illustrating different orientations for attachment of a thumb implement 970 of another exemplary embodiment with thumb implement carrier 902. Thumb implement 970 includes a pair of mounting plates 975 arranged generally parallel, and a cross plate or member 985 extending between mounting plates 975. A blade or cutting edge 980 is attached to each of implement mounting plates 975. In this embodiment, thumb implement 970 has a two-aperture arrangement with apertures 977A and 977B in each implement mounting plates 975. Apertures 977A and 977B are arranged such that they allow the thumb implement 970 to be attached to thumb implement carrier 902 at apertures 914A and 914B, or at apertures 914A and 914C, to vary the attitude of blade or cutting edge 980 with respect to the thumb implement carrier. As can be seen in the thumb implements 940 and 970, the mounting plates can include a function feature on an end thereof to perform a thumb related task or can be attached to a feature such as a blade or cutting edge to perform a thumb related task.

The thumb implements shown and discussed above are generally designed to cooperate with a primary implement such as a bucket to perform a single task such grasping or clamping an object using both the primary implement and thumb implement. In other embodiments, a thumb implement can be designed not to cooperate, per se, with the primary implement, but to perform a second work function independent of a work function of the primary implement. Some examples of non-cooperating thumb implements are a soil conditioner implement and a compactor implement. The term non-cooperating or non-cooperation refers to the concept that each implement can perform a task independent of the other. These tasks can often be related (such as, for example, digging with a bucket and later performing a soil condition operation) even though they are independently performed. The capability of performing these tasks without changing implements is a significant advantage to this concept.

In some applications, i.e., with some thumb implements, it may be advantageous to allow a thumb implement to float with respect to the arm to which it is attached. In the various embodiments discussed above, an actuator that is pivotally attached to an arm and an implement carrier (such as actuator 210 shown in FIG. 2) controls the position of the thumb implement. By powering the actuator, the position of the thumb implement with respect the arm is positively changed. However, as mentioned above, in certain applications it is desirable to allow the implement to move without an affirmative powering of the actuator. This movement is referred to as a float condition. Two different approaches to allow for float of an implement with respect to the arm are discussed in embodiments below.

A first approach to allow for float of an implement is to provide an environment where an implement carrier is capable of floating with respect to an arm. Before describing an embodiment that allows for an implement carrier to float with respect to an arm, a system is illustrated for controlling an actuator (such as actuator 210) of the type that can be pivotally attached to an arm (such as arm 200) and an implement carrier (such as thumb implement carrier 302) for positioning the implement carrier with respect to the arm.

Figure 19:
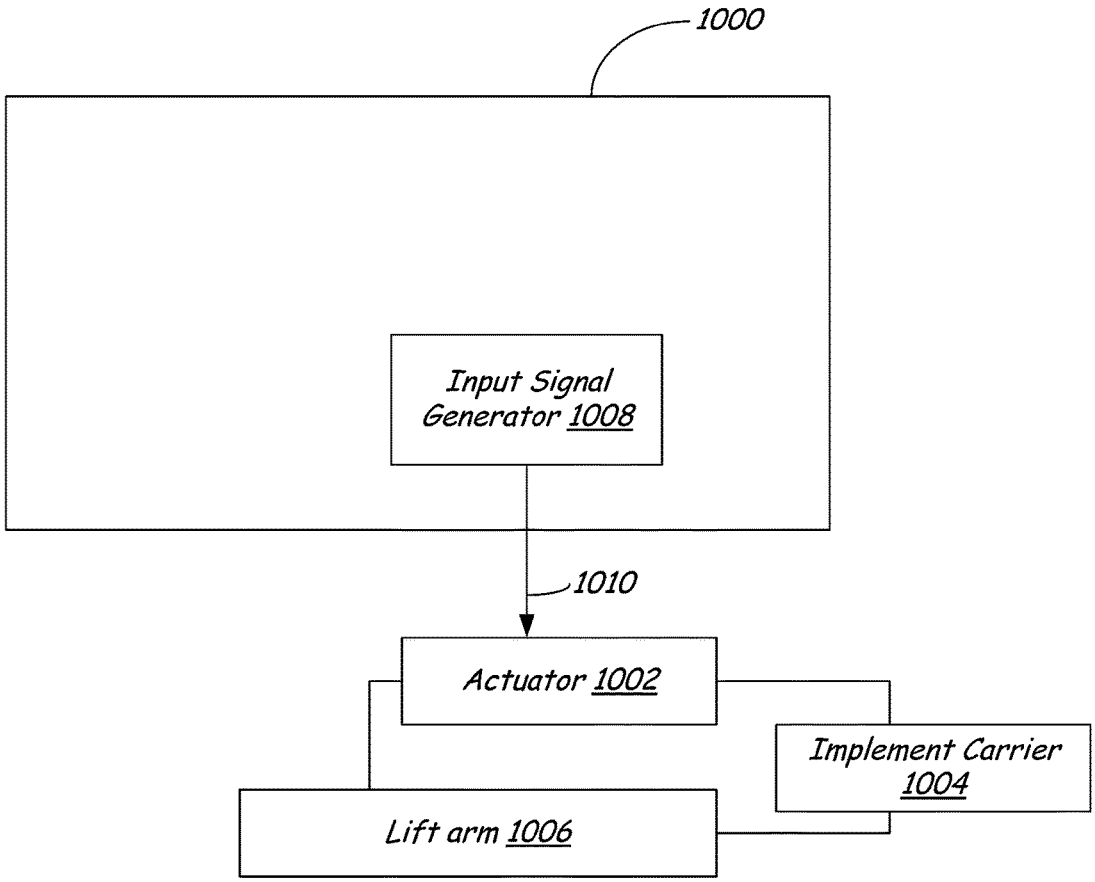
FIG. 19 is a block diagram that illustrates an actuator control system for controlling an actuator coupled to a thumb implement carrier according to one illustrative embodiment.

Referring to FIG. 19 is a block diagram that illustrates an actuator control system 1000 for controlling an actuator 1002 on a power machine of the type that can position an implement carrier 1004 or other structure with respect to a lift arm 1006 according to one illustrative embodiment. The actuator control system 1000 is configured to operate in a first operating mode when the actuator control system 1000 selectively causes the actuator to move under power or maintain a position in response to operator inputs and a second mode, in which the actuator is allowed to move freely, that is, move without power, which is required for a structure such as an implement carrier to float. The actuator 1002 is shown in the block diagram as being coupled to the lift arm 1006 and the implement carrier 1004 so that when the actuator is actuated, either under power or otherwise, the implement carrier 1004 moves with respect to the lift arm 1006. While the concepts related to control of an actuator are described with respect to lift arm 1006 and implement carrier 1004, these concepts can be incorporated into several other lift arm, implement carrier, and actuator combinations, including those discussed above. The actuator control system 1000 includes an input signal generator 1008 that is configured to provide a power signal 1010 to power the actuator 1002. The input signal generator 1008 provides the input signal 1010 in response to an operator's action (such as manipulating an input device) that is performed to control the actuator 1002. The power signal 1010 is provided to the actuator 1002 to cause the actuator 1002 to actuate or not actuate. One example of an actuator that can controlled by actuator control system 1000 is a hydraulic cylinder such as the actuator 210 shown in FIG. 2, although other actuators such as electric motor controlled linear actuators, can employ an actuator control system in the general framework shown in FIG. 19 and described above. The power supply is, in one embodiment, provided in the form of pressurized hydraulic fluid. Alternatively, the power supply can be provided in the form of electrical signals.

Figure 20:
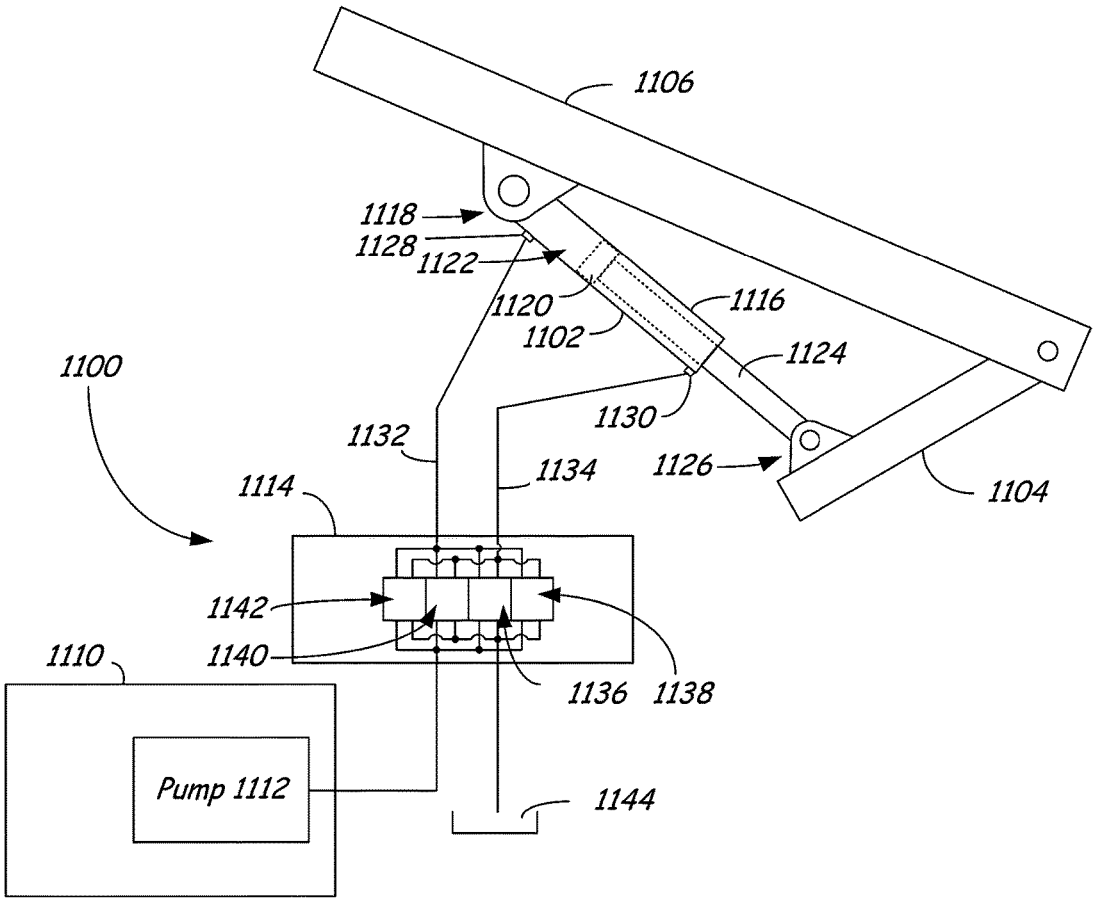
FIG. 20 a simplified block diagram of an actuator control system showing components configured for controlling an actuator coupled to a thumb implement carrier and capable of allowing the thumb implement carrier to float according to one illustrative embodiment.

FIG. 20 is a simplified block diagram of an actuator control system 1100 capable of controlling an actuator 1102 in the form of a hydraulic cylinder that is pivotally coupled to both an implement carrier 1104 and an arm 1106 according to one embodiment. The actuator control system 1100 is one embodiment of an actuator control system shown generally in FIG. 19 and is one illustrative embodiment of an actuator control system that selectively allows a hydraulically powered implement carrier to float with respect to an arm to which it is pivotally coupled. Other embodiments can employ other components without departing from the scope of the discussion.

A power conversion system 1110 includes a pump 1112 that provides a source of pressurized hydraulic fluid to a control valve 1114, which in turn is operably coupled to the actuator 1102 for selectively providing hydraulic fluid to the actuator 1102. The actuator 1102 is illustratively a cylinder having a cylinder body 1116 having an attachment feature 1118 at a first end for pivotally attaching the actuator to one of the arm 1106 and the implement carrier 1104 (attachment feature 1118 is shown attached to the arm 1106 in FIG. 20). A piston 1120 is disposed and moveable within a cavity 1122 in the cylinder body 1116 and a rod 1124 is attached to the piston 1120 and extends from a second end of the cylinder body. An attachment feature 1126 is provided on an end of the rod 1124 opposing the piston 1120 for attachment to the other of the arm 1106 and the implement carrier 1104. The cylinder body 1116 has a pair of apertures 1128 and 1130 located proximal to the first and second ends of the cylinder body 1116 to allow pressurized hydraulic fluid to enter and exit the cavity 1122 on either side of the piston 1120 under control of the power conversion system 1110 and more particularly in the embodiment shown in FIG. 20, under control of the control valve 1114. By allowing pressurized hydraulic fluid to enter through the aperture 1128 and exit through aperture 1130, the piston 1120 will be forced toward the second end of the cavity 1122 and therefore cause the rod 1124 to extend out of the cylinder body 1116. Conversely, by allowing pressurized hydraulic fluid to enter through the aperture 1130 and exit through aperture 1128, the piston 1120 will be forced toward the first end of the cavity 1122 and therefore cause the rod 1124 to retract into the cylinder body 1116. The extension and retraction of the rod 1124 causes the implement carrier 1104 to pivot with respect to the arm 1106. Control valve 1114 is operably coupled to the actuator 1102 via conduits 1132 and 1134 to allow for the flow of pressurized hydraulic fluid between the control valve 1114 and the actuator 1102.

As illustrated in FIG. 20, the control valve 1114 can be operated in four different operating positions: first, second, third, and fourth operating positions 1136, 1138, 1140, and 1142, respectively. The first three of the operating positions, discussed below, involve supplying a power signal to actuator 1102 to cause the actuator to move or hold actuator 1102 in a position, which coincides with the first operating mode discussed above with respect to actuator control system 1000. A fourth operating position of the control valve 1114 allows the actuator 1102 to move freely or float with respect to the arm 1106, which coincides with the second operating mode discussed above. When the control valve 1114 is in the first operating position 1136, the control valve 1114 is positioned to prohibit any flow of pressurized hydraulic fluid between the control valve 1114 and the actuator 1102. Thus, when the control valve 1114 is in the first operating position 1136, the actuator 1102 holds the implement carrier 1104 in a generally fixed position relative to the arm 1106. When the control valve 1114 is moved to the second operating position 1138, pressurized hydraulic fluid from the pump 1112 is provided through the control valve 1114 through conduit 1132 and aperture 1128, causing piston 1120 to move and expel hydraulic fluid through conduit 1134 and control valve 1114 to a reservoir 1144. This forces the rod 1124 to extend further out of the cylinder body 1116. In the third operating position, the control valve 1114 provides pressurized hydraulic fluid from the pump 1112 through the control valve 1114 through conduit 1134 and aperture 1130, causing piston 1120 to move and expel hydraulic fluid through conduit 1132 and control valve 1114 to a reservoir 1144. This forces the rod 1124 to retract into the cylinder body 1116. In some embodiments, the flow of pressurized hydraulic fluid out of control valve 1114 in either or both of the second and third operating positions is variable to allow for different flow rates, as may be desired to control the speed at which the rod 1124 extends or retracts. When the control valve 1114 is in the fourth operating position 1142, the control valve 1114 provides a path to the reservoir 1144 for each of the conduits 1132 and 1134, thereby allowing the piston 1120 to move within the cavity based on forces applied to it other than via pressurized hydraulic fluid. One example of a force applied to the piston 1120 is the weight of the implement carrier 1136, which is transferred through rod 1124 to the piston 1120. In this fourth operating position, the implement carrier 1104 is thus unpowered by the actuator 1102 and is allowed to float, for example over a terrain.

Figure 21:
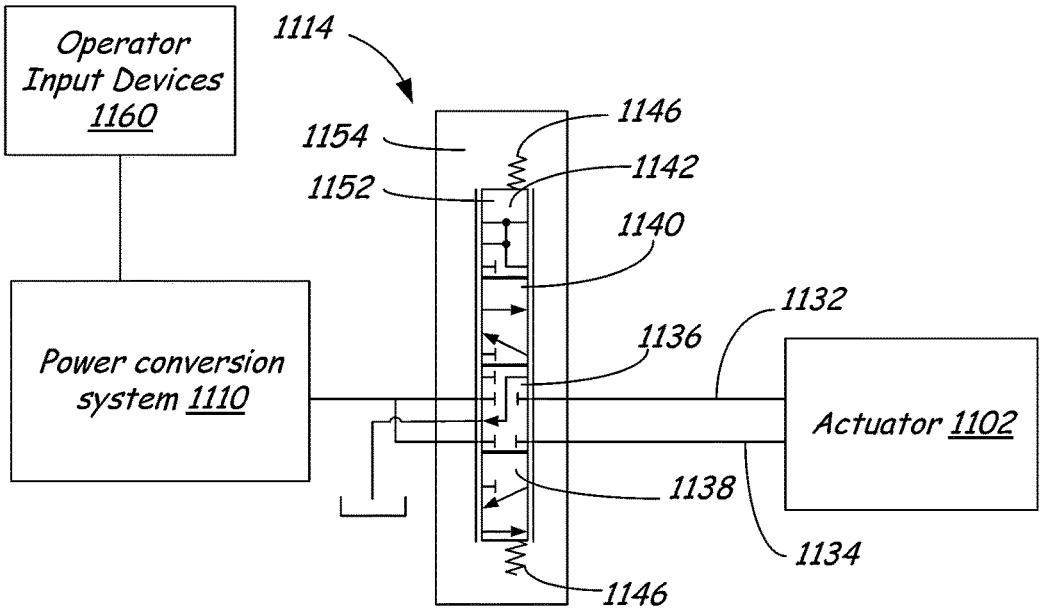
FIG. 21 is a schematic illustrating one embodiment of a control valve for an actuator control valve of the type illustrated in FIG. 20.

A more detailed version of the control valve 1114 is shown in FIG. 21 and the relevant features are described below. The control valve 1114 includes, in some embodiments, a spool 1152 housed in a valve body 1154. Alternatively, multiple valve elements such as a plurality of spool valves or cartridge valves can be assembled to form a control valve capable of providing the operating states of control valve 1114 described above. The spool 1152 can be one spool in a larger valve assembly, or it can be a stand-alone spool in valve body 1134. The power conversion system 1110, in various embodiments, can have other components in communication with control valve 1114 to perform various functions, such as relief valves and the like. For the sake of brevity, only those components that enable the specific operating conditions set forth above in one particular embodiment are shown and discussed.

The spool valve 1152 shows the four operating positions 1136, 1138, 1140, and 1142 discussed above, respectively. Also shown are centering mechanisms in the form of springs 1146, which bias the spool to a default the functions set forth by the concepts discussed herein are shown. In one embodiment, the spool valve is positioned by selectively providing pressurized hydraulic fluid from the power conversion system 1110 via one or more operator input devices 1160 to position the spool 1152 as desired. The one or more operator input devices 1160 are manipulable by an operator to provide pressurized hydraulic fluid to select one of the four valve positions as desired. Alternatively, electrically controlled actuators can be provided to shift the spool 1152 between the four operating positions 1136, 1138, 1140, and 1142 in response to manipulation of operator input devices.

Figure 22:
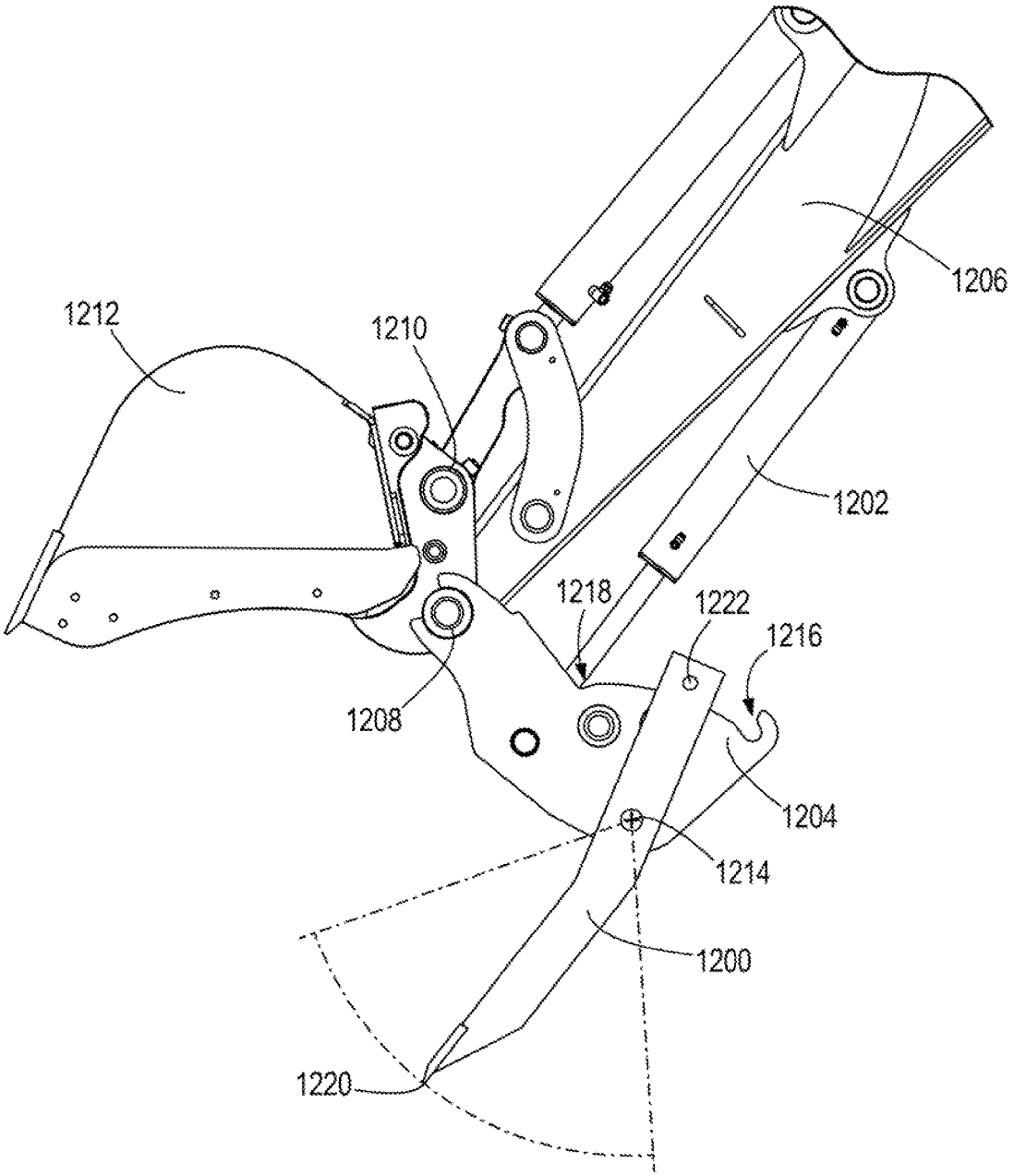
FIG. 22 illustrates an implement with a mechanical float mechanism configured to allow floating movement with respect to an implement carrier to which it is attached, according to one illustrative embodiment.

A second approach to allow for float or unpowered movement of an implement with respect to an arm with which it is operably coupled is to provide an environment where an implement is capable of floating with respect to an implement carrier to which it is coupled. FIG. 22 illustrates one embodiment of such an implement 1200, which is coupled to an implement carrier 1204. Implement carrier 1204 is similar to implement carriers 902 and 1104 discussed above. For example, implement carrier 1204 is attached to an arm 1206 at a pivot joint 1208 and is powered to pivot about the arm 1206 by an actuator 1202. As with other embodiments discussed above, a primary implement carrier 1210 is pivotally coupled to arm 1206, also at pivot joint 1208. An implement 1212, in the form of a backhoe bucket (although other implements can be used) is secured to the primary implement carrier 1210.

Implement 1200 is coupled to implement carrier 1202 at joint 1214 and is allowed to pivot about the joint 1214 so that locating peg 1222 can move between a first stop 1216 and a second stop 1218, thereby defining a maximum allowable rotational movement of the implement 1200 with respect to the implement carrier 1202. As shown in FIG. 22, the implement 1200 is capable of pivoting in a range of motion shown by arc 1220. The implement carrier 1204 is capable of accepting the types of implement discussed above. In such instances, an implement is attached along two different joints to preclude rotation of the implement with respect to the implement carrier 1204. In some embodiments, a biasing arrangement in the form of a torsional spring or other type of spring or biasing mechanism can be provided to position the implement in a default position with respect to the implement carrier until a force, such as can be provided by engagement with a support surface, overcomes the biasing mechanism. Of course, the implement 1200 can be positioned by movement under power of the implement carrier 1204 as well. In the case where implement 1200 is attached to an implement carrier that is itself capable of floating with respect to an arm, as is described in the first approach to allowing for float above, float can be accomplished through both an approach where the implement carrier is capable of floating with respect to the arm and the implement is capable of floating with respect to the implement carrier.

Figure 23:
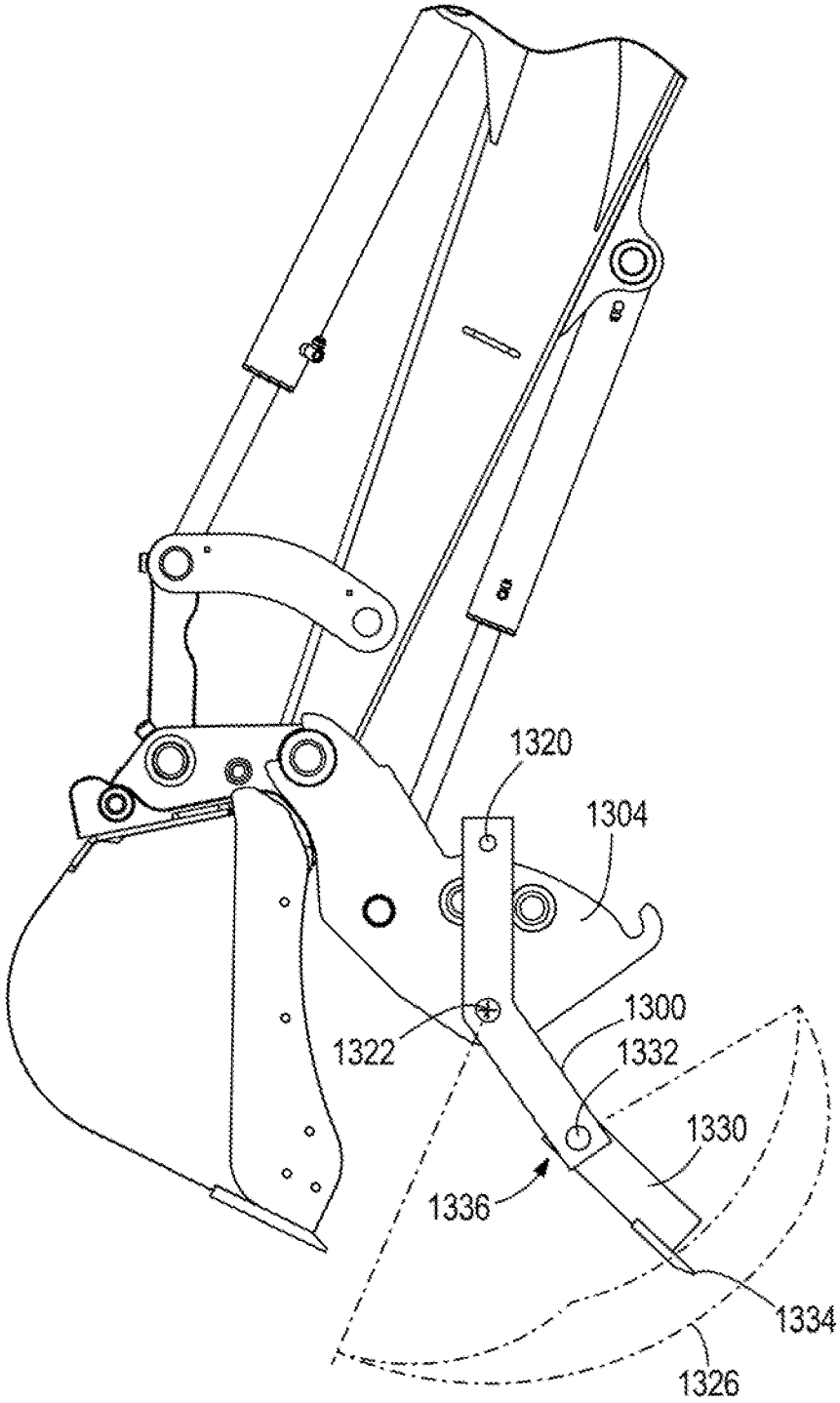
FIG. 23 illustrates an implement with a mechanical float mechanism configured to allow floating movement of one portion of the implement with respect to another portion of the implement, according to one illustrative embodiment.

A third approach to allow for float or unpowered movement of an implement with respect to an arm with which it is operably coupled is to provide an implement such as implement 1300 illustrated in FIG. 23 that has a first portion 1320 that is pivotally mounted to implement carrier 1304 (which is similar to implement carrier 1204 above) at joint 1322 and a second portion 1330 that is pivotally mounted to the first portion 1320 at joint 1332. This arrangement provides an additional degree of freedom for the implement. The possible range of movement for an end 1334 of the second portion 1330 of the implement 1300 is shown by curve 1326. A catch 1336 on the second portion 1330 is capable of engaging the first portion 1320 to limit rotational travel of the second portion 1330 with respect to the first portion 1320 in at least one direction. In some embodiments, a catch can limit travel in two directions or a second catch can limit travel in a second direction. While the catch is shown on the second portion, in some embodiments the catch is provided on the first portion. As with other embodiments disclosed above, a biasing member can bias the implement with respect to the implement carrier and likewise, a biasing member can be provided, in some embodiments, to bias the second portion of the implement with respect to the first portion. In other embodiments, the implement carrier 1304 can be capable of floating as discussed above. Some implements with a second portion that is pivotable with respect to the first portion are fixed to the implement carrier at two joints to preclude pivoting with respect to the implement carrier.

Figure 24:
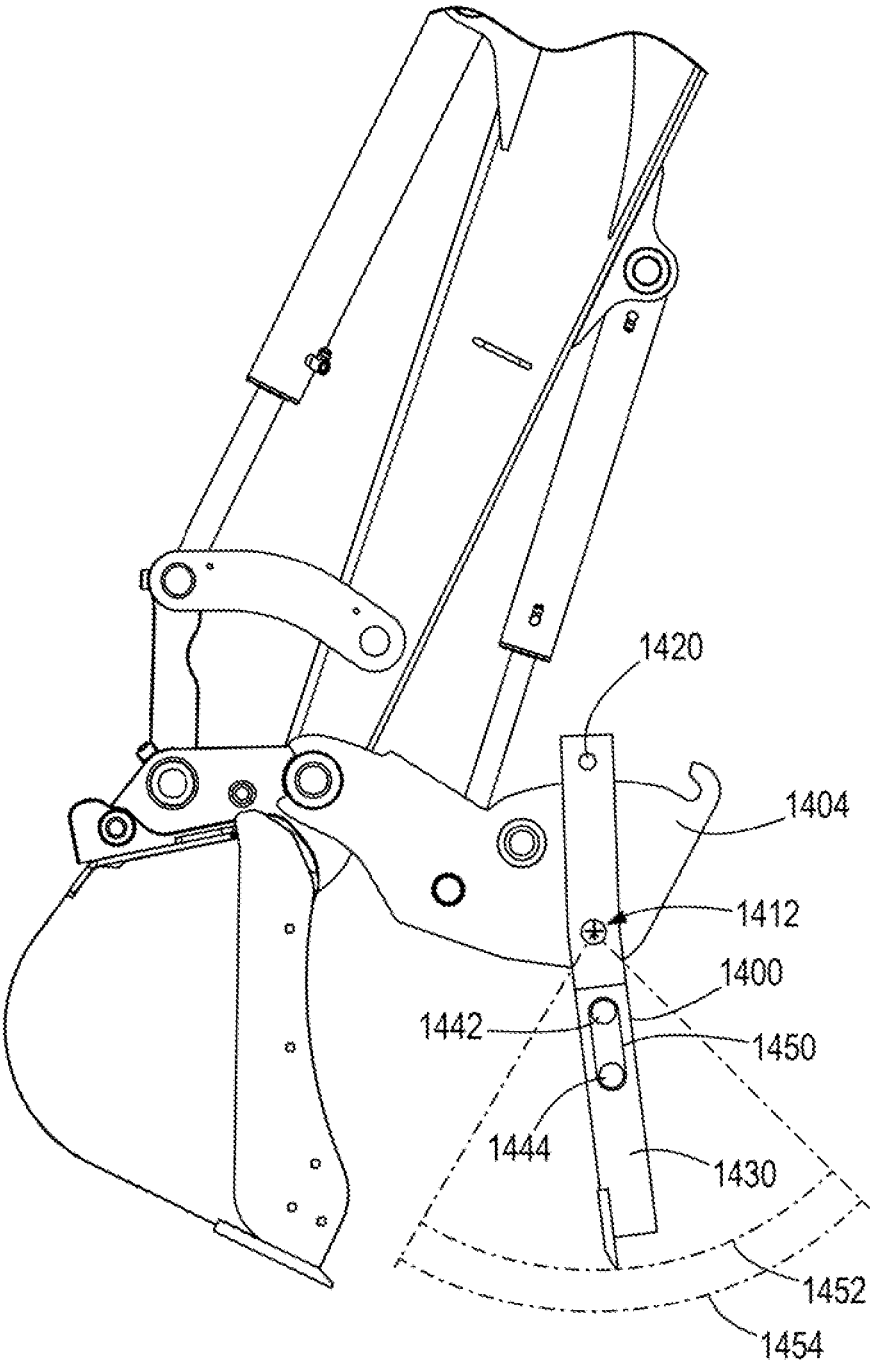
FIG. 24 illustrates an implement with a mechanical float mechanism configured to allow floating movement of one portion of the implement with respect to another portion of the implement, according to another illustrative embodiment.

FIG. 24 illustrates another example of an implement 1400 attached to an implement carrier 1404 and having a first portion 1420 and a second portion 1430 that is moveable with respect to the first portion to create an implement of varying length. The first portion 1420 is attached to the implement carrier 1402 at a joint 1412. A slot 1450 formed in the second portion 1430 is engaged by a pair of pins or tabs 1442 and 1444. The second portion 1430 can then be extended between a minimum length shown by first curves 1452 and a maximum length shown by curve 1454. In one embodiment, the second portion 1430 is capable of moving freely, subject to the constraints of the slot 1450. Alternatively, the second portion 1430 can be fixed into a position within the constraints of the slot 1450. Alternatively still, a tension mechanism such as a spring can bias the second portion to a maximum extension and also allow retraction in response to an external force.

The embodiments disclosed herein provide important advantages. Implement carriers of the type disclosed above allow for multiple attachment attitudes, which advantageously allows different implement to be positioned differently on a given machine and a given implement to be positioned differently on different machines. As one example of this flexibility, thumb implement carriers and thumb implements that can be attached to the thumb implement carriers of the type disclosed herein provide flexibility for operators of the power machines on which they are employed. A single thumb implement can be arranged in a variety of orientations and positions so that the thumb implement can be employed to do a number of different tasks. Thumb implements and/or thumb implement carriers described above that provide for a plurality of different coupling orientations provide increased utility and flexibility. By allowing an implement to float with respect to an arm, certain tasks may be performed more effectively. Any of the options discussed above for float mechanisms provide additional and improved functionality over the prior art.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. For example, in various embodiments, different types of power machines can be configured to employ the disclosed thumb implement assembly. Other examples of modifications of the disclosed concepts are also possible, without departing from the scope of the disclosed concepts.

What is claimed is:

1. An implement in combination with an implement carrier:

the implement comprising:

a first implement surface having a first implement mounting feature;

a second implement surface having a second implement mounting feature; and a positioning feature;

the implement carrier comprising:

a mounting structure configured to be pivotally mounted to a lift arm and further configured to receive and secure an implement thereto, the mounting structure having first and second mounting structure surfaces and a contoured surface;

a first plurality of mounting features located along the first mounting structure surface; and a second plurality of mounting features located along the second mounting structure surface, each of the second plurality of mounted features being aligned with one of the first plurality of mounting features;

wherein the mounting structure is configured to receive an implement in a first attitude and in a second attitude different from the first attitude;

wherein when the implement is unattached to the implement carrier, the contoured surface is engageable by the positioning feature on the implement such that movement of the positioning feature along the contoured surface aids in aligning the first mounting feature on the implement with one of the first plurality of mounting features on the first mounting structure surface; and wherein when the implement is attached to the implement carrier, the first implement surface is adjacent the first mounting structure surface of the mounting structure and the first implement mounting feature is engaged with one of the first plurality of mounting features of the implement carrier.

2. The combination of claim 1, wherein the first plurality of mounting features includes first, second, and third mounting features arranged on the first surface of the implement carrier such that the first mounting feature is out of alignment with the second and third mounting features.

3. The combination of claim 2, wherein the mounting structure includes an alignment surface engageable by a positioning feature on the implement and such that movement of the positioning feature along the alignment surface aids in aligning a mounting feature on the implement with one of the first, second, and third mounting features on the first mounting structure surface.

4. The combination of claim 3, wherein the alignment surface includes a plurality of positioning stops configured to engage the positioning feature, and wherein when the positioning feature is engaged with different ones of the plurality of positioning stops, the mounting feature on the implement is alignable with different ones of the first plurality of mounting features.

5. The combination of claim 1, wherein the implement includes a first portion attached to the implement carrier and a second portion pivotally attached to the first portion.

6. The combination of claim 1, wherein when the implement is attached to the implement carrier, the second implement surface is adjacent to one of the second plurality of mounting features.

7. The combination of claim 1, wherein the implement is capable of being attached to the mounting structure in one of the first attitude and the second attitude and is incapable of being attached to the mounting structure in the other of the first attitude and the second attitude.

8. The combination of claim 1, wherein the contoured surface has a first stop and a second stop, wherein when the implement is unattached to the implement carrier and the positioning feature is in engagement with the first stop, the first mounting feature on the implement is capable of being aligned with the first mounting feature on the first mounting structure surface.

9. The combination of claim 8, and further comprising a third stop, wherein when the implement is unattached to the implement carrier and the positioning feature is in engagement with the third stop, the first mounting feature on the implement is capable of being aligned with the second mounting feature on the first mounting structure surface.

10. The combination of claim 8, wherein when the implement is attached to the implement carrier, the implement is capable of pivoting between a first attached position where the positioning feature is in engagement with the first stop and a second attached position where the positioning feature is in engagement with the second stop.

11. The combination of claim 8, wherein when the implement is attached to the implement carrier, the first implement mounting feature is pivotally engaged with one of the first plurality of mounting features on the first mounting structure surface and wherein the combination further includes a tension mechanism capable of resisting pivotal movement of the implement with respect to the implement carrier.

12. A power machine having a frame and a lift arm operably coupled to the frame at one end of the lift arm, comprising:

an implement attachment apparatus attached to the lift arm for accepting a primary implement on the lift arm proximal to a second end of the lift arm;

an implement carrier pivotally attached to the lift arm for accepting a second implement, the implement carrier including a mounting structure configured to receive the second implement in a first position and a second position, wherein the received second implement is oriented with a different attitude in the second position with respect to the mounting structure than in the first position;

a first actuator operably coupled to the lift arm for selectively providing power to pivot the implement attachment apparatus relative to the lift arm; and a second actuator pivotally coupled to the implement carrier and the lift arm for selectively providing power to pivot the implement carrier with respect to the lift arm, wherein the second actuator is independently operable with respect to the first actuator; and an actuator control system including a control valve that is configured to control the second actuator in a first control mode and a second control mode, wherein in the first control mode the control valve is actuable to selectively provide pressurized fluid to control the second actuator to selectively move the implement carrier under power in one of a first and a second direction and selectively prevent movement of the second actuator and in the second control mode, the control valve is actuable to allow the second actuator to move freely and the implement carrier to float;

wherein the control valve is moveable between first, second, third and fourth operating positions.

13. The power machine of claim 12, wherein the actuator control system controls the second actuator to selectively move the implement carrier under power in a first direction and a second direction.

14. The power machine of claim 12, wherein when the actuator control system operates in the first control mode, the control valve is moveable between the first, second and third operating positions and when the actuator control operates in the second control mode, the control valve is moved to the fourth operating position.

15. The power machine of claim 14, wherein the actuator control system further includes a reservoir and a pump, wherein the second actuator is a hydraulic cylinder in communication with the control valve and wherein when the control valve is in the fourth position, each of the first and second ends of the actuator are in communication with the reservoir.

16. The power machine of claim 12, wherein the implement attachment apparatus is pivotally attached to the arm about an axis and the implement carrier is attached to the arm about the same axis.

17. The power machine of claim 12, wherein the implement attachment apparatus for accepting the primary implement is an implement carrier.

18. A power machine, comprising:

a frame;

a lift arm pivotally coupled to the frame;

an implement attachment apparatus attached proximal to an end of the lift arm for accepting a first implement on the lift arm; and an implement carrier pivotally mounted on the lift arm for accepting a second implement on the lift arm, including:

a mounting structure configured to receive and secure an implement thereto in a first attitude and in a second attitude different from the first attitude, the mounting structure having first and second mounting plates each of which is configured to be coupled to an implement;

a first plurality of mounting features located along the first mounting plate;

a second plurality of mounting features located along the second mounting plate, each of the second plurality of mounted features being aligned with one of the first plurality of mounting features; and wherein the first mounting plate has a contoured portion formed along an outer edge, separate from any of the first plurality of mounting features, configured to engage a positioning feature on the implement and having a positioning stop formed into the outer edge such that movement of the positioning feature into the positioning stop aids alignment of the implement in the first attitude.

19. An implement carrier, comprising:

a mounting structure configured to be pivotally mounted to a lift arm and further configured to receive and secure an implement thereto, the mounting structure having first and second mounting plates spaced apart by a cross member and an alignment surface extending along one of the first and second mounting plates orthogonal to a main surface thereof engageable by a positioning feature on the implement with the alignment surface having an arcuate portion;

a first plurality of mounting features located along the first mounting structure surface; and a second plurality of mounting features located along the second mounting structure surface, each of the second plurality of mounted features being aligned with one of the first plurality of mounting features;

wherein the mounting structure is configured to receive the implement in a first attitude and in a second attitude different from the first attitude and wherein movement of the positioning feature along the alignment surface aids in aligning a mounting feature on the implement with one of the mounting features on the first mounting structure surface and wherein movement of the positioning feature includes a non-linear path of travel as it moves over the arcuate portion of the alignment surface.

* * * * *